US007091815B2

(12) United States Patent
Suzui

(10) Patent No.: US 7,091,815 B2
(45) Date of Patent: Aug. 15, 2006

(54) ELECTRICAL DEVICE, TRANSFORMER, AND INDUCTOR, AND METHOD OF MANUFACTURING ELECTRICAL DEVICE

(75) Inventor: Masaki Suzui, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/737,780

(22) Filed: Dec. 18, 2003

(65) Prior Publication Data

US 2004/0183642 A1 Sep. 23, 2004

(30) Foreign Application Priority Data

Dec. 19, 2002 (JP) ..... 2002-368483

(51) Int. Cl.
*H01F 5/00* (2006.01)

(52) U.S. Cl. ..... 336/200

(58) Field of Classification Search ..... 336/65, 336/83, 192, 200, 220–223, 232, 198
See application file for complete search history.

(56) References Cited

U.S. PATENT DOCUMENTS

| | | | | |
|---|---|---|---|---|
| 4,498,067 | A | 2/1985 | Kumokawa et al. | 336/65 |
| 4,755,784 | A | 7/1988 | Taoka et al. | 336/96 |
| 5,923,237 | A * | 7/1999 | Sato et al. | 336/212 |
| 6,825,748 | B1 * | 11/2004 | Ibata et al. | 336/200 |

FOREIGN PATENT DOCUMENTS

| | | |
|---|---|---|
| EP | 0 270 417 | 6/1988 |
| EP | 0 387 441 | 9/1990 |

* cited by examiner

*Primary Examiner*—Tuyen T Nguyen
(74) *Attorney, Agent, or Firm*—Fitzpatrick, Cella, Harper & Scinto

(57) ABSTRACT

An adhering process of adhering a winding, after the winding is wound on the bobbin, to a bobbin entirely or partly with an adhesive tape, for the purpose of reliably fixing the winding to the bobbin, increases the manufacturing cost of a transformer. To solve this problem, a primary winding (13) is wound on a winding core (111). Extracting portions of the primary winding (13) are caused to intersect, and their terminal ends are connected to terminals (14) which oppose each other through the winding core (111) and which are arranged within a region having end portions of a winding space of the winding core (111) as boundaries.

20 Claims, 28 Drawing Sheets

ELECTRICAL DEVICE, TRANSFORMER, AND INDUCTOR, AND METHOD OF MANUFACTURING ELECTRICAL DEVICE

FIELD OF THE INVENTION

The present invention relates to an electrical device such as a transformer or inductor, and a method of manufacturing the same.

BACKGROUND OF THE INVENTION

FIG. 1 is a view showing the arrangement of the winding portion of a transformer. As shown in FIG. 1, an electric wire (winding) 3 is wound on a bobbin 1 made of an electric insulator. After that, the winding 3 is entirely or partly adhered to the bobbin 1 with an adhesive tape 2 so that the winding 3 may be reliably fixed to the bobbin 1. If the winding 3 has a sufficient number of turns, it can hold the bobbin 1; if the winding 3 has a small number of turns (e.g., one turn), it is difficult to fix the winding 3 to the bobbin 1. For this reason, it is very important to adhere the winding 3 to the bobbin 1 with the adhesive tape 2 or the like.

To adhere the winding 3 with the adhesive tape 2, the bobbin 1 must have a wide winding space. Consequently, a bobbin 1 having a large winding space is necessary, sometimes leading to an increase in the size of the transformer. Also, the adhering process using the adhesive tape 2 increases the manufacturing cost of the transformer.

The terminals of the bobbin 1 to which two terminal end portions 5 of the winding 3 are to be connected are generally arranged in the vicinity of the bottom surface of the bobbin 1 which forms a hollow prism or cylinder. Hence, after winding, extracting portions 4 of the winding 3 must be pulled out in directions largely different from the winding direction. Accordingly, for example, when a plurality of coils are to be formed on the bobbin 1, a plurality of extracting portions 4 occupy the winding space of the bobbin 1. Formation of the extracting portions 4 obviously complicates the winding process of the winding 3.

To decrease the resistance of the coil, sometimes a plurality of coils are formed in one layer on the bobbin 1 and are connected parallel to each other. If, however, the winding 3 is far from the terminals to which the two terminal end portions 5 are to be connected, its extracting portions 4 become long. Particularly, when the winding 3 has a small number of turns (e.g., one turn), the proportion of the extracting portions 4 in the entire length of the winding 3 becomes large. If the plurality of coils are formed in one layer, the differences in electric wire length among the coils become conspicuous. Therefore, even when the coils are connected parallel to each other, the total resistance of the coils does not decrease so much for the number of parallel coils. Also, due to the differences in resistance, the current values among the coils differ.

SUMMARY OF THE INVENTION

The present invention has been made to solve the above problems separately or at once, and has as its object to facilitate winding. As a means for achieving this object, the present invention has the following arrangement. An electrical device according to the present invention is an electrical device having not less than one coil, and is comprising a winding core on which the coil is to be wound, and at least one set of terminals which oppose each other through the winding core and which are arranged within a region having end portions of a winding space of the winding core as boundaries, wherein extracting portions of the coil intersect, and terminal ends of the extracting portions are connected to the terminals.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Electrical devices according to the embodiments of the present invention will be described in detail with reference to the accompanying drawings.

[Outline]

Figure 1:
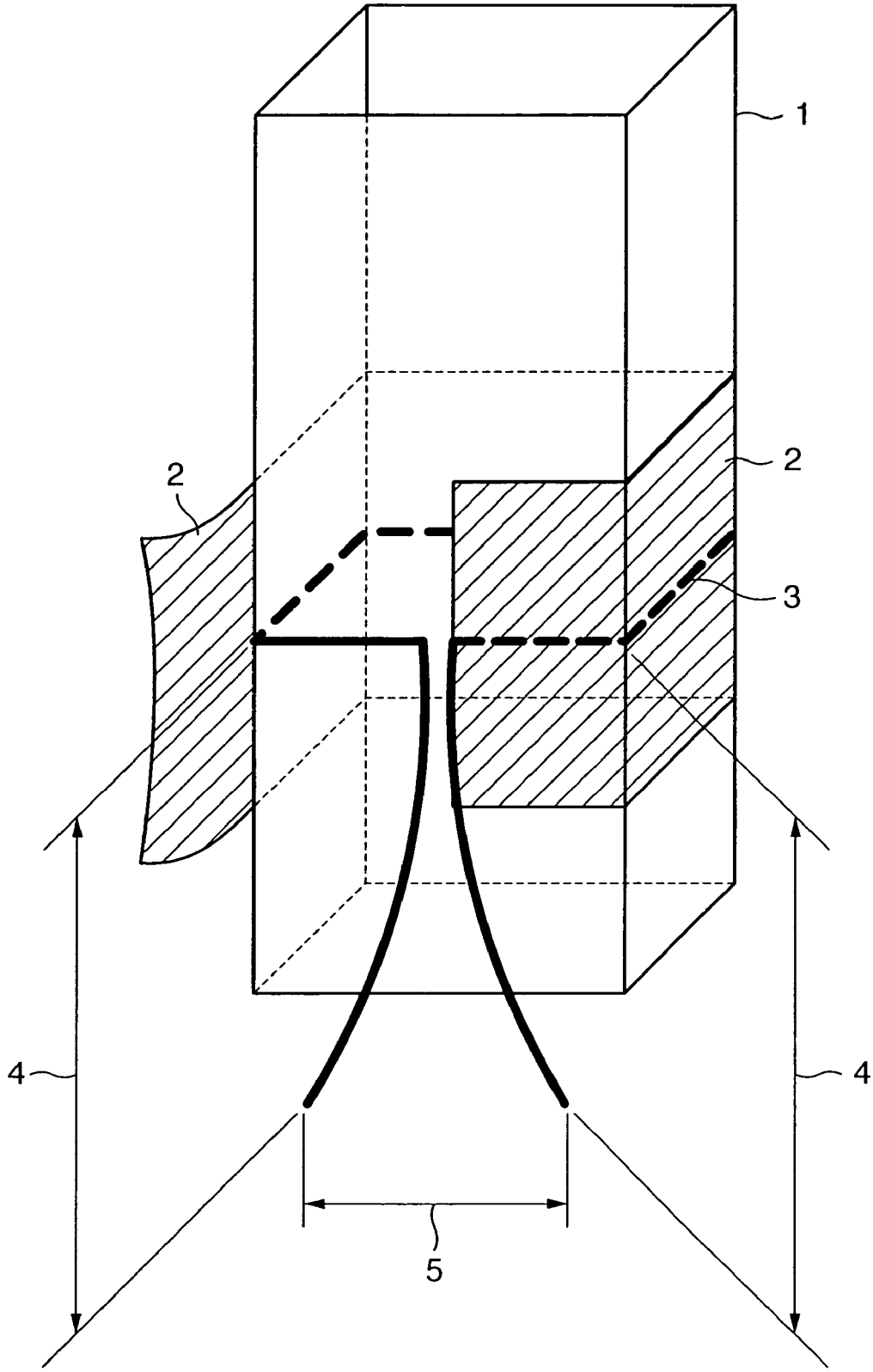
FIG. 1 is an outer appearance perspective view schematically showing the arrangement of the winding portion of a transformer.
Figure 2:
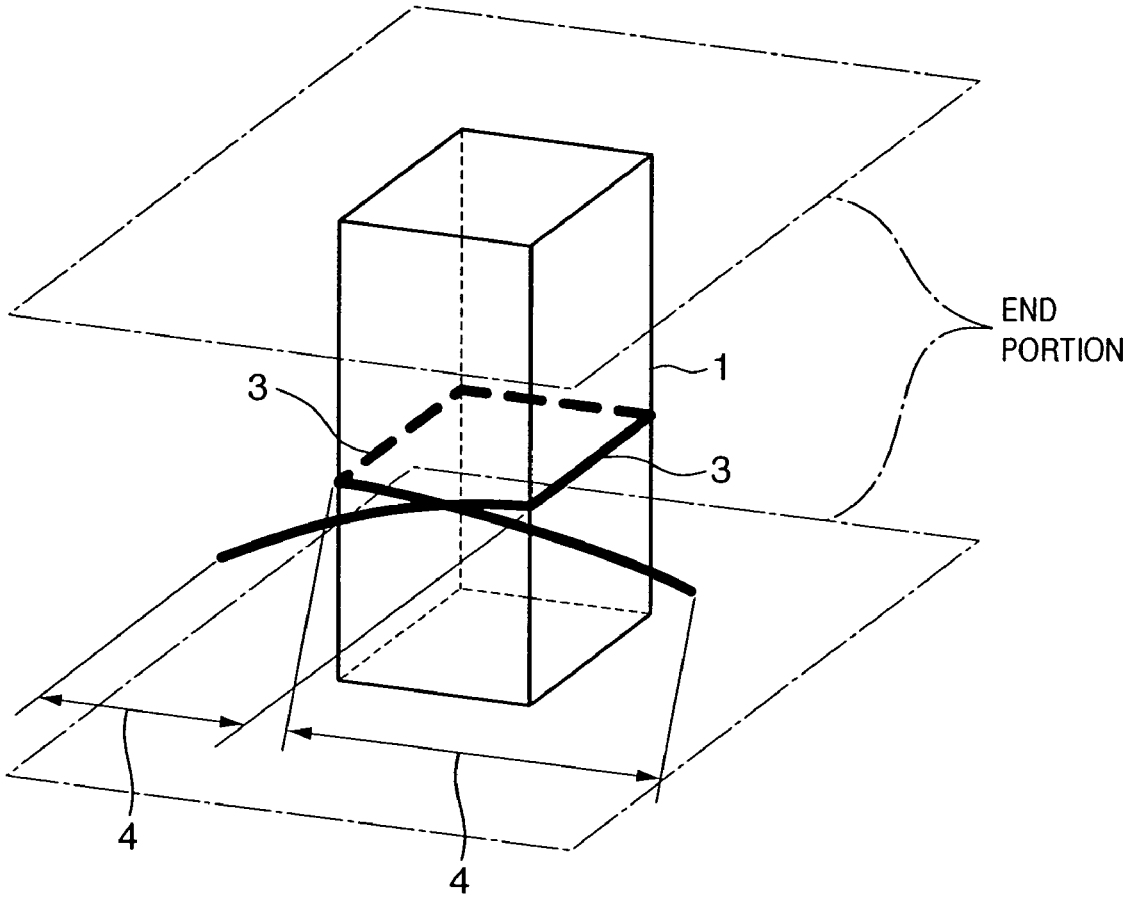
FIG. 2 is an outer appearance perspective view schematically showing the outline of a winding according to an embodiment.

As shown in FIG. 2, in a transformer (or inductor) according to an embodiment, terminals are arranged at positions opposing each other through a bobbin 1 and within a region having the bottom surfaces of the bobbin 1 as boundaries. Extracting portions 4 of a winding 3 are crossed, and their terminal end portions are fixed to the terminals.

With this arrangement, in the transformer of this embodiment, the winding 3 need not be adhered with an adhesive tape. The winding space occupied by one coil can be further reduced, so that the transformer can be downsized. The winding process is simplified and the workability is improved very much, thus reducing the manufacturing cost of the transformer. Since the extracting directions of the extracting portions 4 substantially coincide with the winding direction of the winding 3, operation such as bending the extracting portions 4 at the bases becomes unnecessary, leading to excellent workability. Also, the damage to the conductor portion or insulating covering of the winding 3 can be minimized since the bending operation is eliminated, an electric wire with a larger section can be wound easily. Thus, the degrees of freedom in designing the transformer increase.

Figure 3:
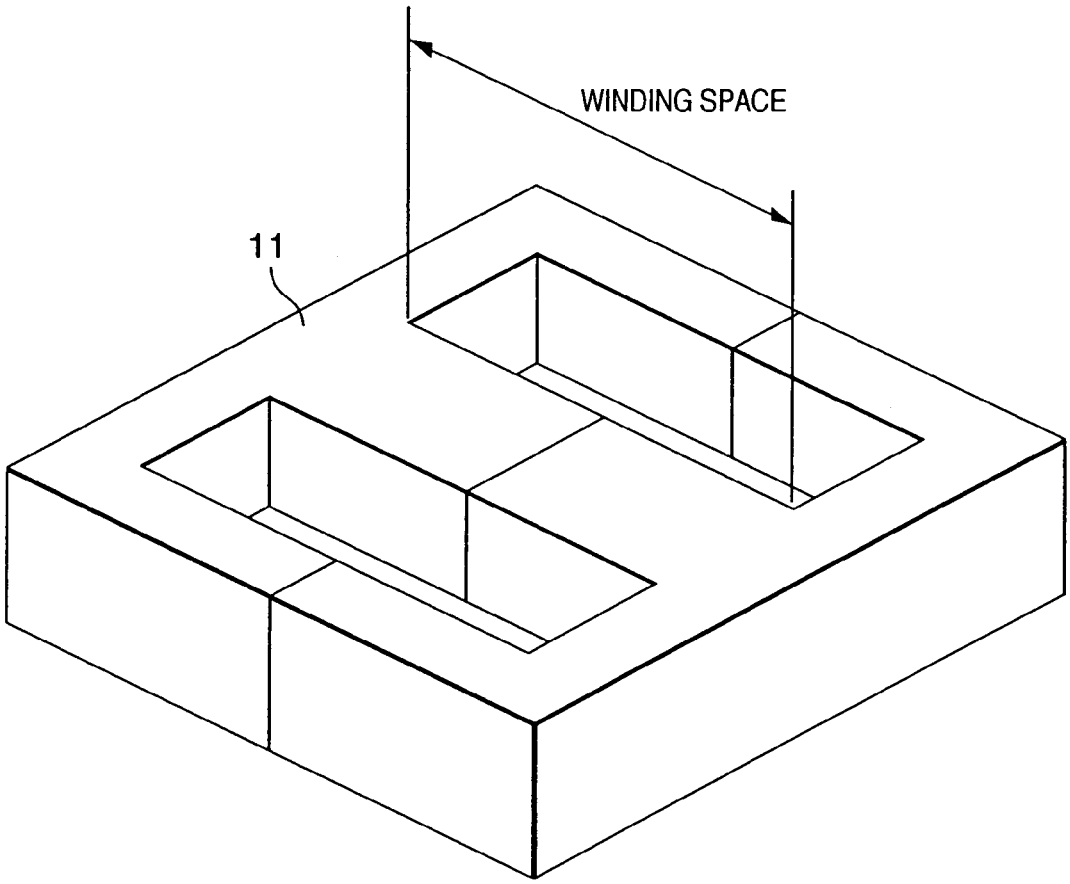
FIG. 3 is an outer appearance perspective view for explaining a winding space in EE-type cores.

The winding space refers to a range along the shaft of the bobbin, where a winding can be wound on the bobbin. For example, FIG. 3 is a view for explaining a winding space in EE-type cores. As shown in FIG. 3, when a coil is to be built in middle legs 11 of the EE-type cores, an electric wire is wound on a hollow prismatic bobbin corresponding to the middle legs 11 hence the winding space is limited by the distance to the base portions of the middle legs 11. The distance from the base portion of one middle leg 11 to the base portion of the other middle leg 11 forms the winding space. In other words, the bottom surfaces of the bobbin close to the base portions of the middle legs 11 form the end faces of the winding space. The terminals described above are arranged in a region sandwiched by the two end faces. FIG. 3 shows an example in which a coil is to be built in the middle legs 11 of the EE-type cores. When a coil is to be built in the middle legs of EI-type cores or in the legs of UU- or UI-type cores, the terminals are arranged in the same manner. It suffices as far as the terminals described above are arranged between the end faces of the winding space.

Figure 4:
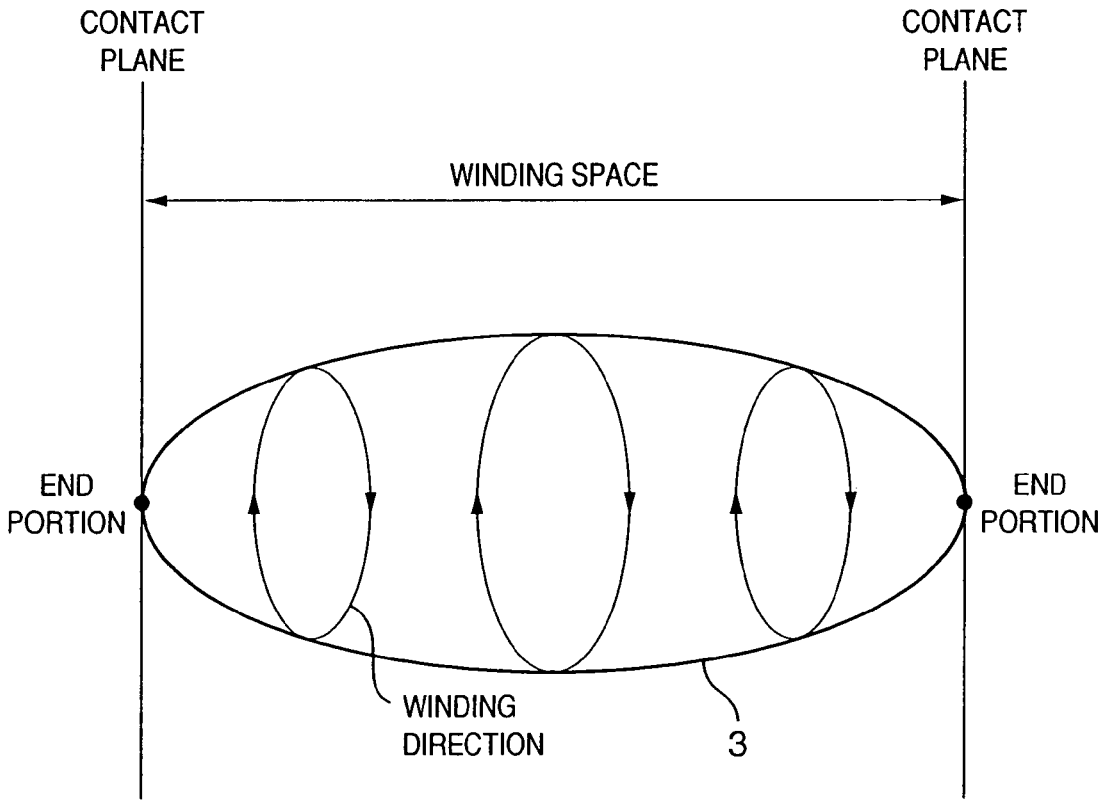
FIG. 4 is a view for explaining the winding space.

In the case of a bobbin as shown in FIG. 4 which has a circular or elliptic section and the sectional area of which decreases toward the two ends of the bobbin, the end faces of the winding space form contact planes at the two end portions of the bobbin, as shown in FIG. 4. Hence, terminals may be arranged in a region between the two contact planes.

The terminals described above correspond to the connecting portions of the winding terminal ends of the coil of a transformer (or inductor) and other components or circuit conductors, and their shapes and materials are not particularly limited. For example, the terminals may be connectors, terminal blocks, pin terminals which serve also as legs used for attaching a transformer to a printed board, or the lands themselves of the printed board.

In general, a transformer (or inductor) uses a bobbin that matches the shape of the cores to be used. When the present invention is applied, terminals are arranged in a region sandwiched by the end faces of the winding space of such a bobbin.

The electrical device with one or more coils, which will be described later in detail, according to this embodiment has a winding core on which the coil is to be wound, and a member which is arranged below the winding core and is in contact with the terminal ends of the coil to electrically connect the terminal ends to the electrical circuit of the board on which the electrical device is mounted.

An electrical device having one or more coils according to this embodiment has a winding core on which the coil is to be wound, and a board having at least a set of terminals which oppose each other through the winding core and which are arranged within a region having the end portions of a winding space of the winding core as boundaries. Extracting portions of the coil intersect, and terminal ends of the extracting portions are connected to the terminals.

With a method of manufacturing an electrical device, according to this embodiment, having one or more coils, the coil may be wound on a winding core. The extracting portions of the coil may be set to intersect, and their terminal ends may be connected to at least a set of terminals which oppose each other through the winding core and which are arranged within a region having the end portions of the winding space of the winding core as boundaries. With a method of manufacturing an electrical device having one or more coils, the coil may be wound on a winding core. The terminal ends of the core may be connected to a member which is arranged below the winding core and which electrically connects the terminal ends and the electrical circuit of a board on which the electrical device is to be mounted.

With a method of manufacturing an electrical device having one or more coils, the coil may be wound on a winding core. The extracting portions of the coil may be set to intersect, and their terminal ends may be connected to one set of terminals on a board which oppose each other through the winding core and which are arranged within a region having the end portions of the winding space of the winding core as boundaries.

First Embodiment and Its Structure

FIGS. 5 to 8 are perspective, front, side, and plan views, respectively, for explaining the structure of a transformer. In the following description, for the sake of descriptive convenience, windings 13 and 15 will be described as primary and secondary windings, respectively, but the primary and secondary windings may be inverted. For the sake of illustrative convenience, no magnetic core 12 is inserted in a bobbin 11. Unless the transformer is a air-core transformer, the magnetic cores 12 are inserted in insertion ports 116 of the bobbin 11.

The bobbin 11 is a bobbin having a general winding core 111 made of an electrical insulating material. The winding core 111 has a flange 112, a pedestal 113, and the insertion port 116 at each of its two ends. Two terminal fixing portions 114 are arranged on the two sides of the winding core 111 to be parallel to the winding core 111.

Figure 5:
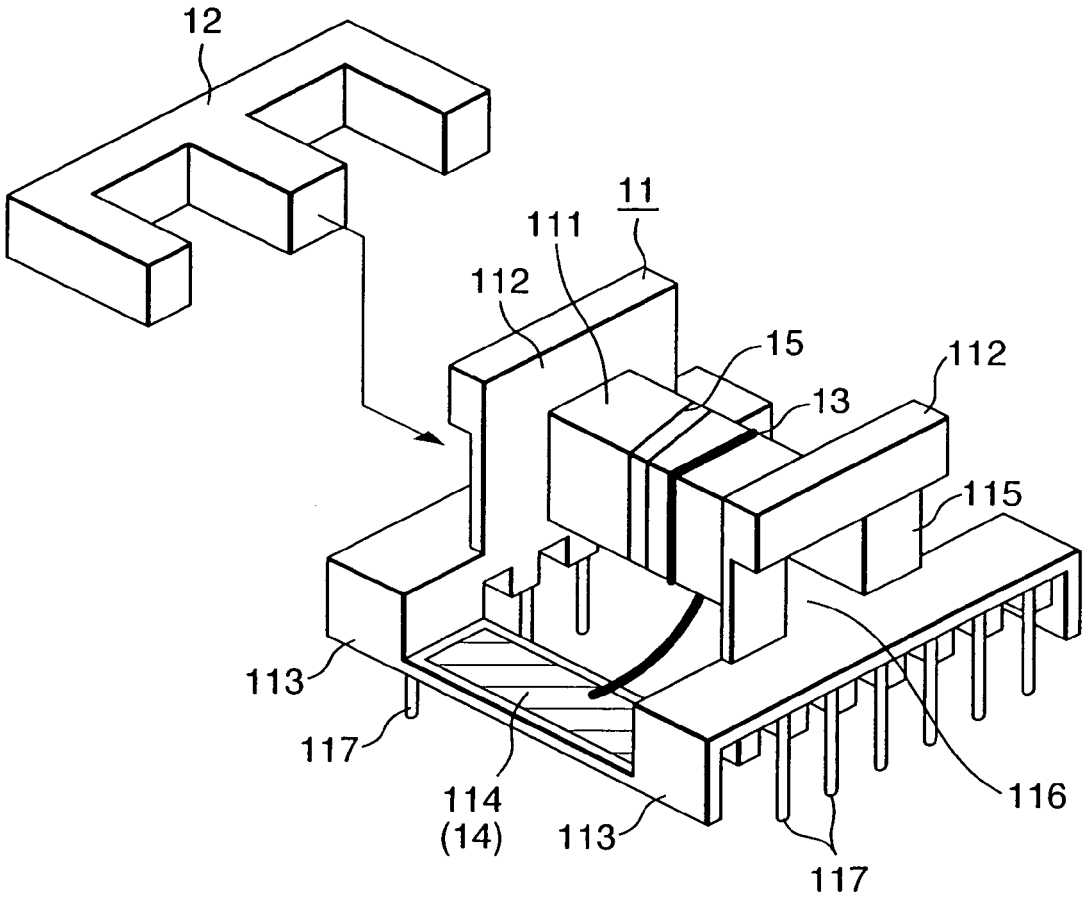
FIG. 5 is a stereoscopic exploded view for explaining the structure of a transformer according to the first embodiment.

The windings 13 and 15 are wound on the winding core 111, and the magnetic cores 12 are inserted in the space in the winding core 111 through the insertion ports 116 (only one EE-type core 12 is shown in FIG. 5). The winding core 111 has the flange 112 at each of its two ends for limiting the winding space. Each flange 112 has a groove 115 for positioning the magnetic core 12. The pedestal 113 attached with a plurality of pin terminals 117 is arranged under each flange 112.

The secondary winding 15 is electrically connected to the circuit conductor of the printed board where the transformer is to be mounted. The pin terminals 117 also serve to position the transformer when mounting it on the printed board, and to fix the transformer to the printed board. The primary winding 13 is electrically connected to terminals fixed to the terminal fixing portions 114, which will be described later in detail.

Figure 9:
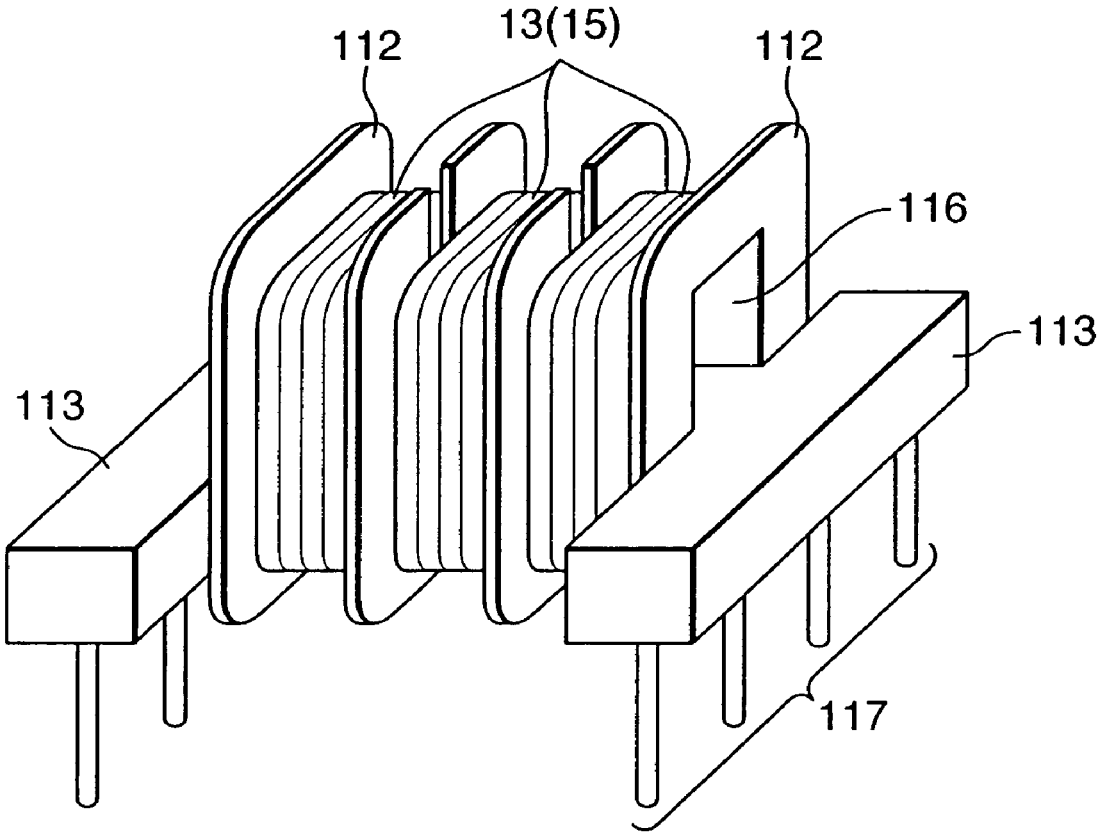
FIG. 9 is an outer appearance perspective view showing a bobbin with a structure in which the winding space is divided into a plurality of portions.

This embodiment is not limited to a bobbin structure which has only one winding space, as shown in FIG. 5, but can also be applied to a bobbin structure in which the winding space is divided into a plurality of portions, as shown in FIG. 9.

Figure 6:
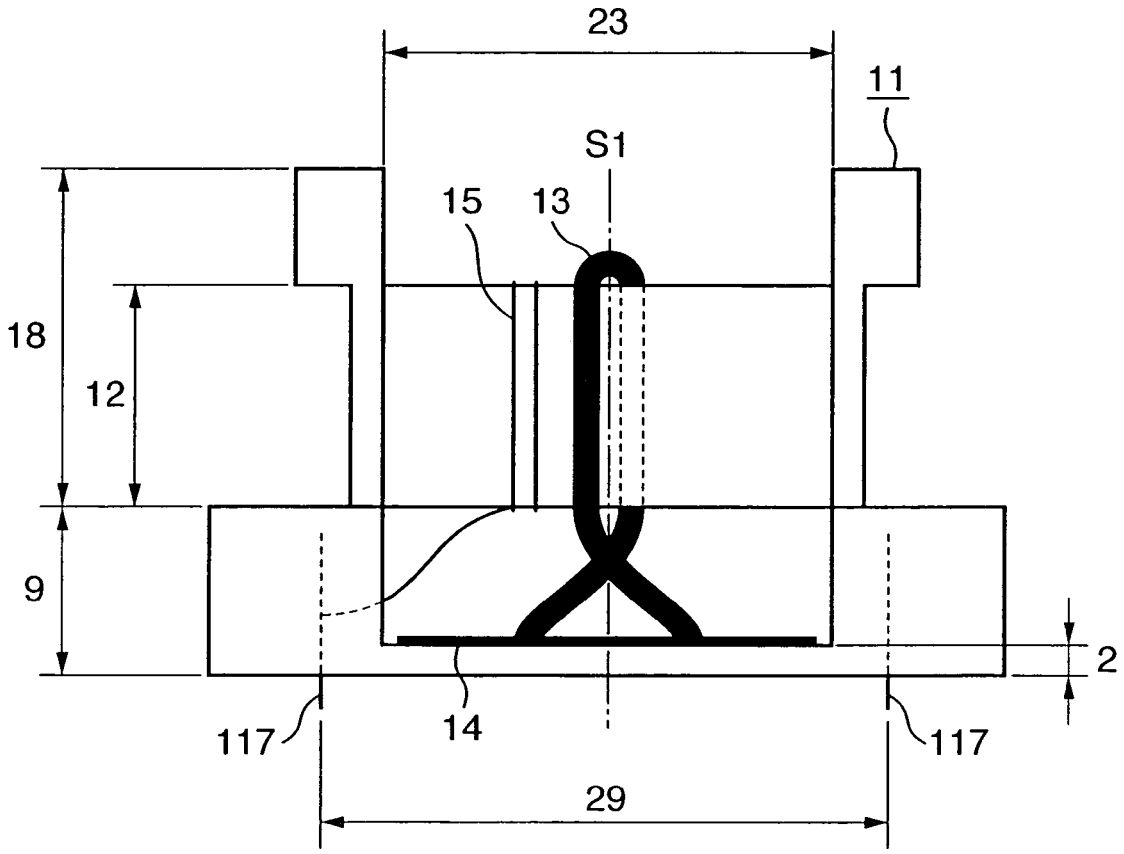
FIG. 6 is a front view for explaining the structure of the transformer according to the first embodiment.
Figure 7:
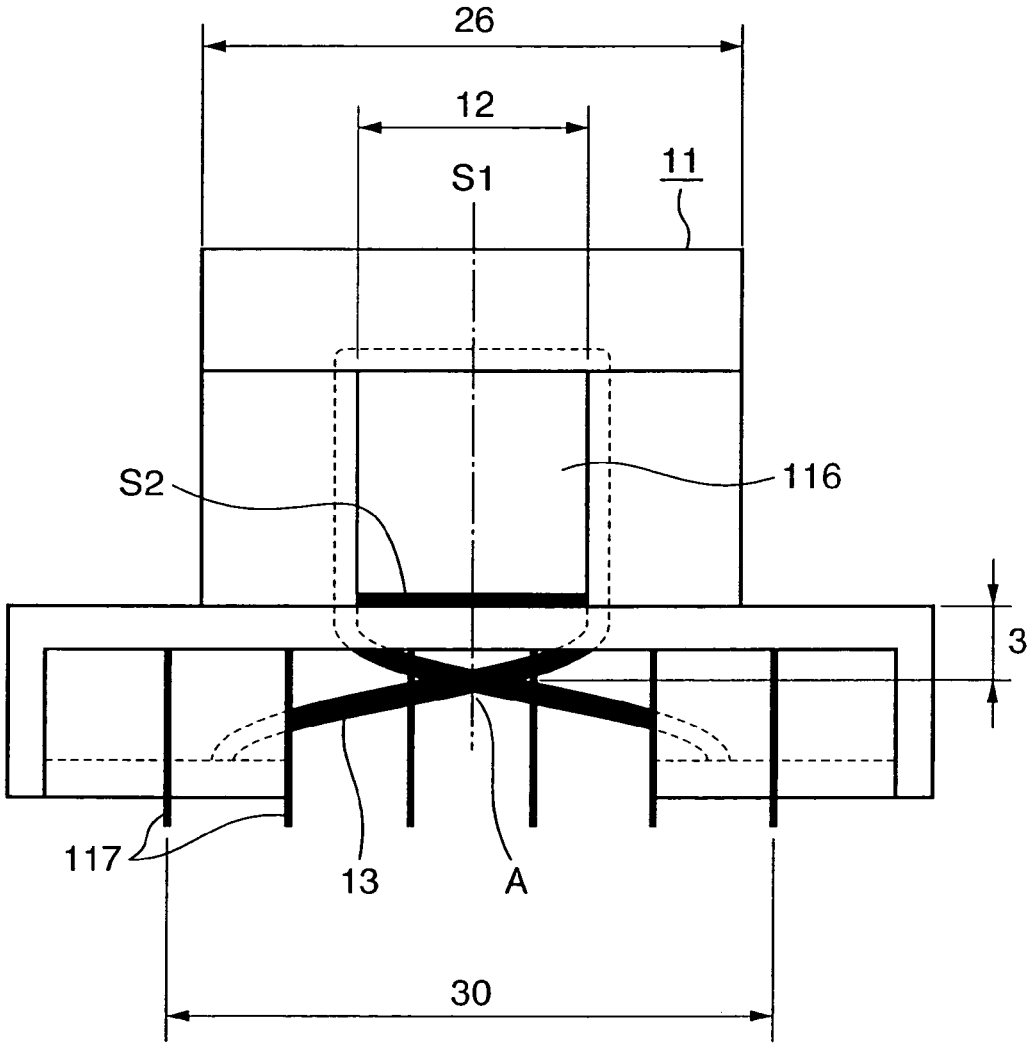
FIG. 7 is a side view for explaining the structure of the transformer according to the first embodiment.
Figure 8:
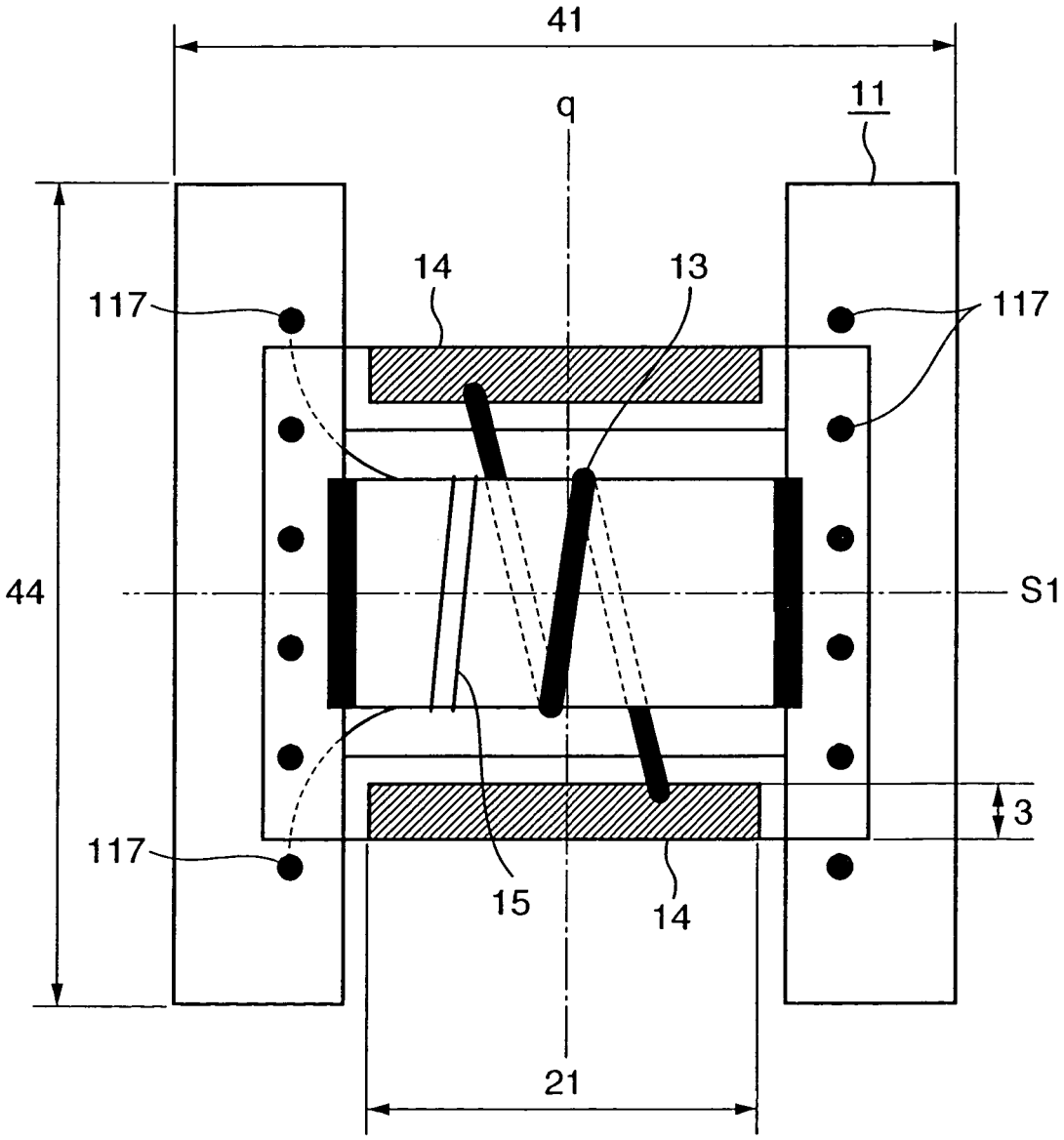
FIG. 8 is a plan view for explaining the structure of the transformer according to the first embodiment.

Regarding the end portions of the winding core 111, as is apparent from FIGS. 5 to 8, the two ends of the winding core 111 form the end portions, and the contact planes of the end portions are the end faces described above. A straight line extending through the center (barycenter) of the section of the winding core 111 will be defined as a center axis q (see FIG. 8). Also, a plane including the center axis q and vertically halving the bobbin 11 along the winding space will be defined as a center plane S1 (see FIGS. 6 and 7). As shown in FIG. 7, of the two planes of the winding core 111 intersecting the center plane S1, the lower plane will be defined as a lower surface S2. As shown in FIG. 8, the center line of the transformer which is on the same plane as the terminal fixing portions 114 and which vertically extends through the center plane S1 will be defined as a straight line q.

The magnetic core 12 is an E-type core made of a ferrite-based magnetic material. One more E-type core (not shown) of the same type is used. The two cores 12 are inserted through the insertion ports 116 at the two ends of the bobbin 11. The shape and material of the magnetic cores 12 are not particularly limited.

As the primary winding 13, one single-type flat square copper wire having a sectional area of 1.5 mm×0.1 mm and a surface insulated with a polyurethane covering is used. To allow soldering of the terminal ends of the primary winding 13 to the terminals 14, the insulating coverings of the terminal end portions of the primary windings 13 are peeled from the ends for about 2 mm. Different from the pin terminals 117, terminals 14 for connecting the terminal end portions of the primary winding 13 are formed of copper plates each having a size of 3 mm (longitudinal dimension)× 21 mm (lateral dimension)×0.1 mm (thickness), and are adhered onto the terminal fixing portions 114. The secondary winding 15 is a polyurethane-covered copper wire having a diameter of 0.1 mm. The secondary winding 15, an adhesive tape (not shown) for fixing the secondary winding 15, and the primary winding 13 are wound onto the winding core 111 in this order, but the winding order is not limited to this. The two terminal end portions of the secondary winding 15 are connected to the pin terminals 117, as shown in FIG. 8.

[Assembly]

How to assemble the transformer will be described hereinafter on the premise that the terminals 14 are to be arranged at the positions shown in FIGS. 6 to 8.

The secondary winding 15 is wound on the winding core 111 by a required number of turns, and is fixed with an adhesive tape. The terminal ends of the secondary winding 15 are soldered to the pin terminals 117. After that, the primary winding 13 is wound on the winding core 111 by one turn such that its entire length becomes a minimum and that a point A where the extracting portions of the primary winding 13 intersect falls on the lower surface S2 side (see FIG. 7). In an ideal case, the point A falls on the center plane S1. Terminal end portions 132 of the primary winding 13 are fixed to the terminal 14 by soldering, as shown in FIG. 8. The primary winding 13 was wound on the winding core 111 and fixed to the terminal 14 with this procedure. A coil reliably maintaining one turn and formed of the primary winding 13 could be formed without requiring the adhesive tape at all. The extracting portions of the primary winding need not be stranded, but need only be crossed once. This facilitates the above winding operation, and the extracting portions need not be made unnecessarily long. The operation of winding the primary winding 13 was done within a very short period of time (less than 1 min).

After this, the magnetic cores 12 are inserted and fixed, thus completing the transformer. These operations are known and accordingly their description will be omitted.

COMPARATIVE EXAMPLE

Figure 10:
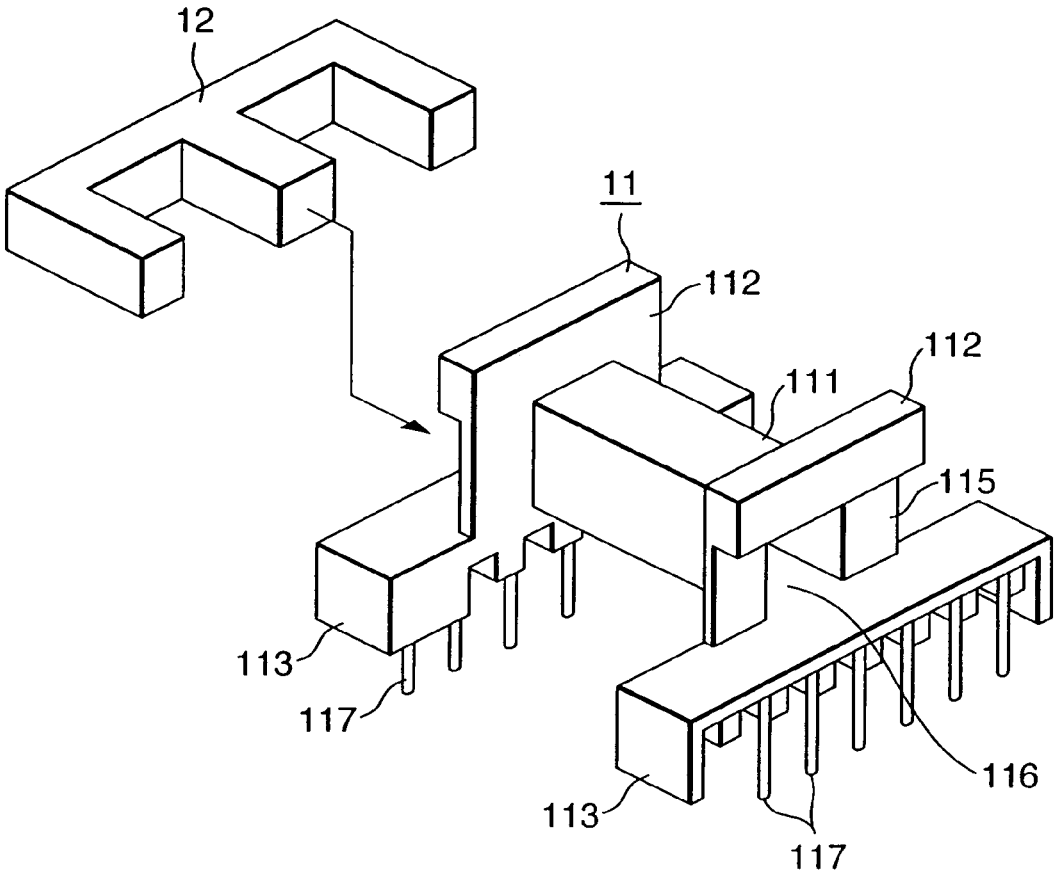
FIG. 10 is a stereoscopic exploded view showing a transformer according to a comparative example.
Figure 11:
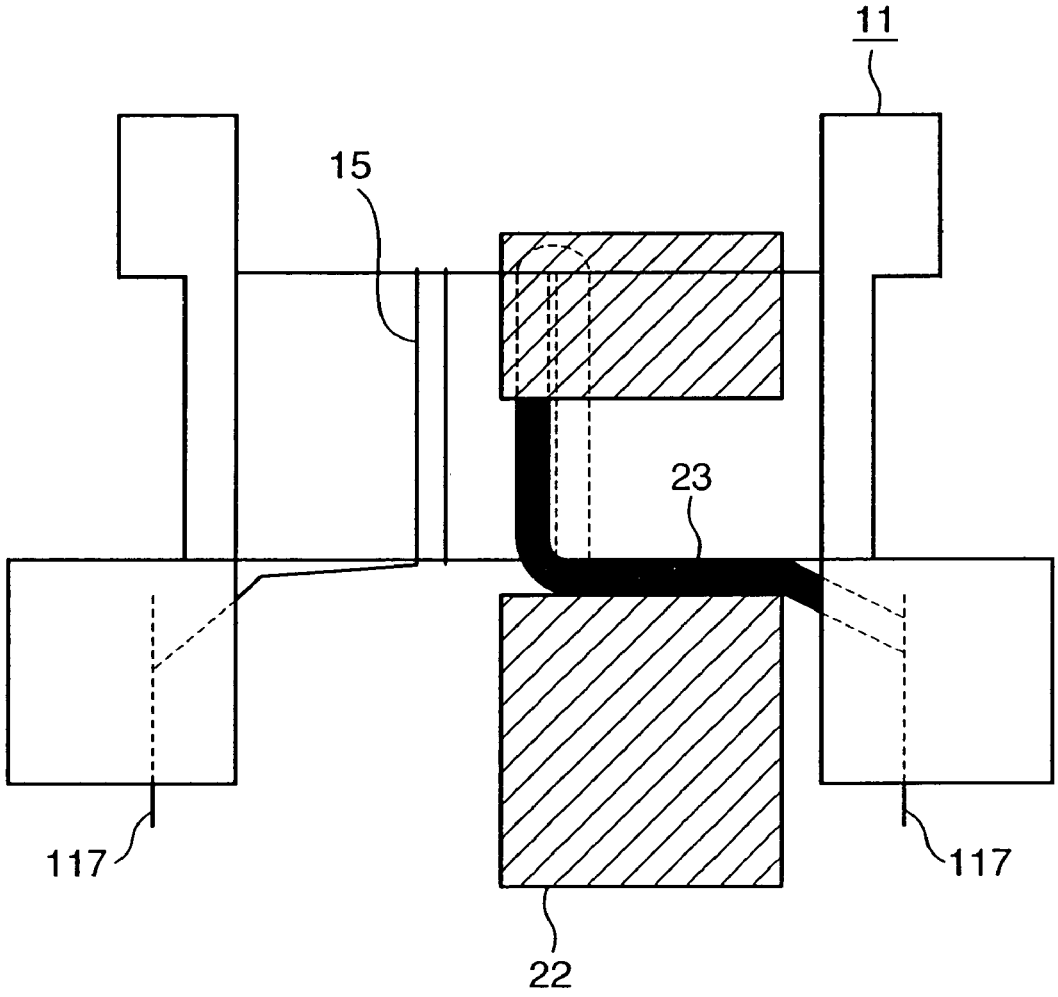
FIG. 11 is a front view showing the transformer according to the comparative example of FIG. 10.
Figure 12:
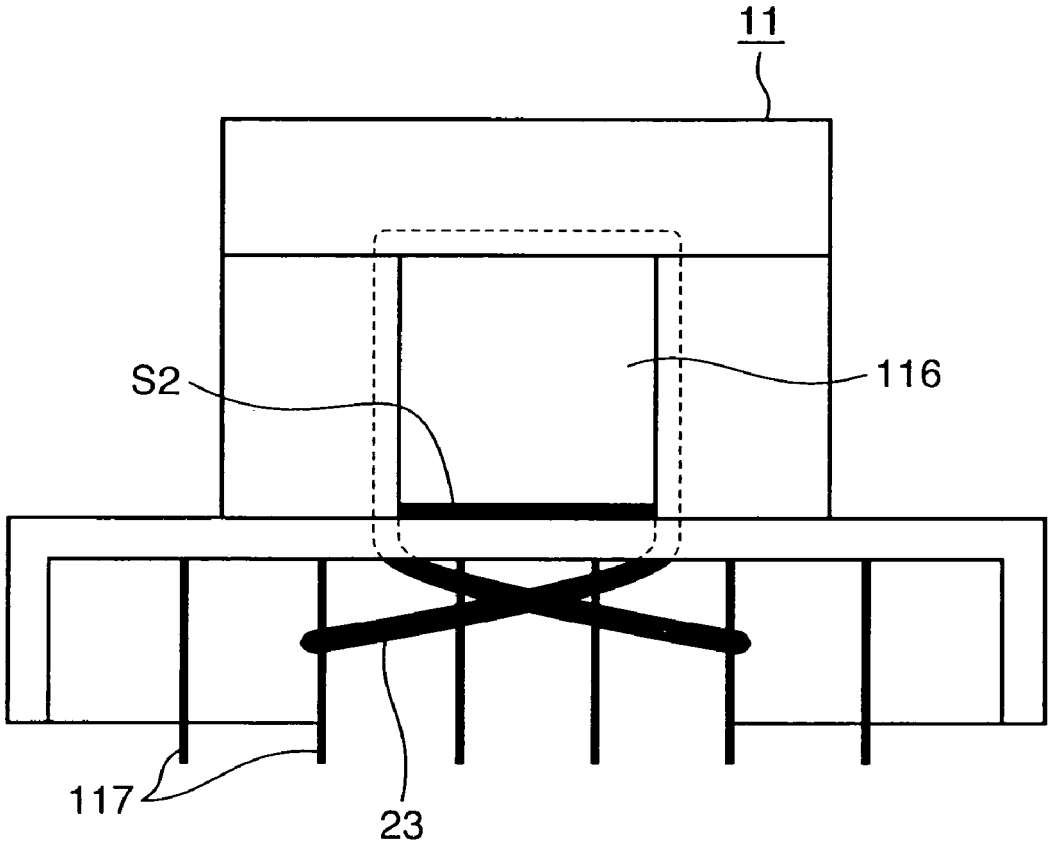
FIG. 12 is a side view showing the transformer according to the comparative example of FIG. 10.

FIGS. 10 to 12 are perspective, front, and side views, respectively of a transformer according to a comparative example. The constituent elements of the comparative example that are substantially identical to those of the transformer according to the embodiment are denoted by the same reference numerals, and a detailed description thereof will be omitted.

The transformer of the comparative example is different from the transformer of the embodiment in a bobbin 21 and primary winding 23. The bobbin 21 is different from the bobbin 11 of the embodiment only in that it has no terminal fixing plates 114. Regarding other constituent elements, for example, the wire of the primary winding 23 is the same as the primary winding 13 of the embodiment. Also, the process for the terminal end portion is the same as that of the embodiment.

As shown in FIGS. 11 and 12, the primary winding 23 is wound on a winding core 111 by one turn from a lower surface S2 side. As shown in FIG. 11, the primary winding 23 including extracting portions of about 10 mm each is fixed to the winding core 111 by using an adhesive tape 22, and the terminal ends of the primary winding 23 are soldered to pin terminals 117. When the primary winding 23 was wound on the winding core 111 and fixed to the pin terminals 117 with this procedure, a coil constituted by the primary winding 23 maintaining one turn was obtained. As shown in FIG. 11, however, the adhesive tape 22 occupied about 12 mm of the 23-mm winding space of the winding core 111, so that the utilization efficiency of the winding space decreased largely. Due to the adhering process using the adhesive tape and because a flat square copper wire employed as the primary winding 23 was difficult to bend, the operation of winding the primary winding 23 took a time of about 10 min.

[Comparison]

In this manner, according to the transformer of the embodiment in which the winding can be fixed to the bobbin 11 without using any adhesive tape 22, the winding space can be utilized more effectively than in the transformer of the comparative example described above. Thus, the transformer can be downsized, the winding process of the winding is simplified, and the workability is improved, so that the winding time of the winding can be reduced greatly. As a result, the manufacturing cost of the transformer can be reduced.

The extracting portions of the winding need only be pulled out in substantially the same direction as the winding direction. In other words, the extracting portions need not be bent by applying an excessive force. Hence, very excellent workability is obtained. Even an electric wire having a large section and thus is difficult to bend (a thick electric wire or flat square wire) can also be employed, so that the degrees of freedom in designing the transformer increase. The damage to the conductor or insulating covering of the winding during winding operation can also be minimized. Although a flat square copper wire is used in this embodiment, the electric wire is not limited to this. For example, an electric wire with a circular or elliptic section, a Litz wire, or a stranded wire may be used. When a Litz wire is used, a resistance in an RF range where the skin effect poses an issue can be decreased.

As shown in, e.g., FIG. 5, an extracting portion will be defined as that portion of the primary winding 13 which is between the terminal end of the primary winding 13 and a separation point where the primary winding 13 is separated from the winding core 111 so that it can be pulled out toward the terminal 14. This definition has nothing to do with the sectional shape of the winding core 111, and applies even when the winding core 111 has a circular, elliptic, triangular, or square sectional shape, or any other polygonal shape. To decrease the entire length of the primary winding 13, preferably, the terminals 14 are close to the point A (see FIG. 7) where the extracting portions intersect (including the position of the strand in the space), and close to the lower surface S2 (see FIG. 7). To further decrease the entire length of the winding, the terminals 14 may be arranged on the same plane as the lower surface S2, or the step between the terminals 14 and the lower surface S2 may be set almost equal to the thickness of the electric wire.

The terminals 14 and the electrical circuit on the printed board where the transformer is to be mounted may be connected to each other by arranging pin terminals under the terminals 14, so that, e.g., copper plates and electric wires may be soldered to the pin terminals. Alternatively, the terminals 14 themselves may be formed longer so that they may be connected to the electrical circuit on the printed board directly.

When the secondary winding 15 is removed from the transformer described above, the resultant arrangement serves as an inductor. Therefore, when the bobbin structure and winding method described above are applied to an inductor, the same effect as that described above can be obtained.

According to the characteristic feature of this embodiment, the terminal end portions of a winding pulled out in its winding direction are fixed to the terminals which oppose each other through a winding core and which are arranged in a region having the end portions of the winding space as boundaries.

The bobbin of the embodiment may be formed by monolithic molding of a resin, or by combining a first member having a core, an upper flange, and an insertion port that are formed by monolithic molding, with a second member having a pedestal, pin terminals, and output terminal plates that are formed by monolithic molding. In the case of combination, if the first member on which winding has been completed is connected to the second member, the winding process becomes easy.

Second Embodiment

An electrical device according to the second embodiment of the present invention will be described. In the second embodiment, arrangements that are substantially the same as those of the first embodiment are denoted by the same reference numerals, and a detailed description thereof will be omitted.

Figure 13:
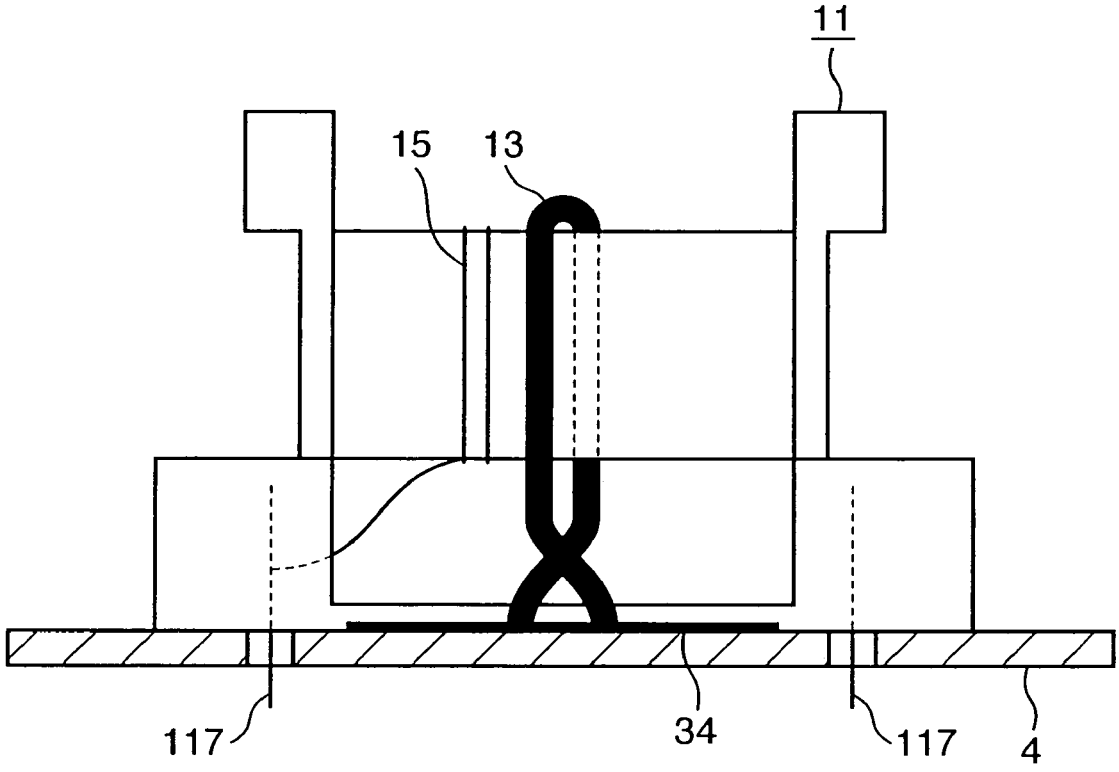
FIG. 13 is a front view for explaining the structure of a transformer according to the second embodiment.
Figure 14:
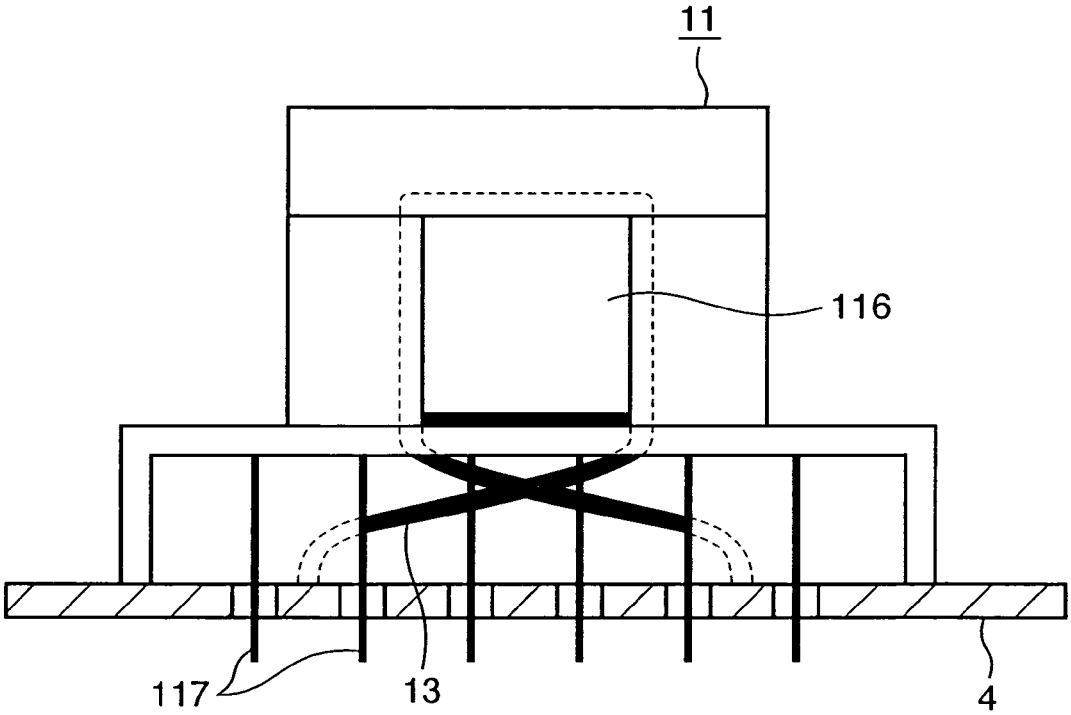
FIG. 14 is a side view for explaining the structure of the transformer according to the second embodiment.
Figure 15:
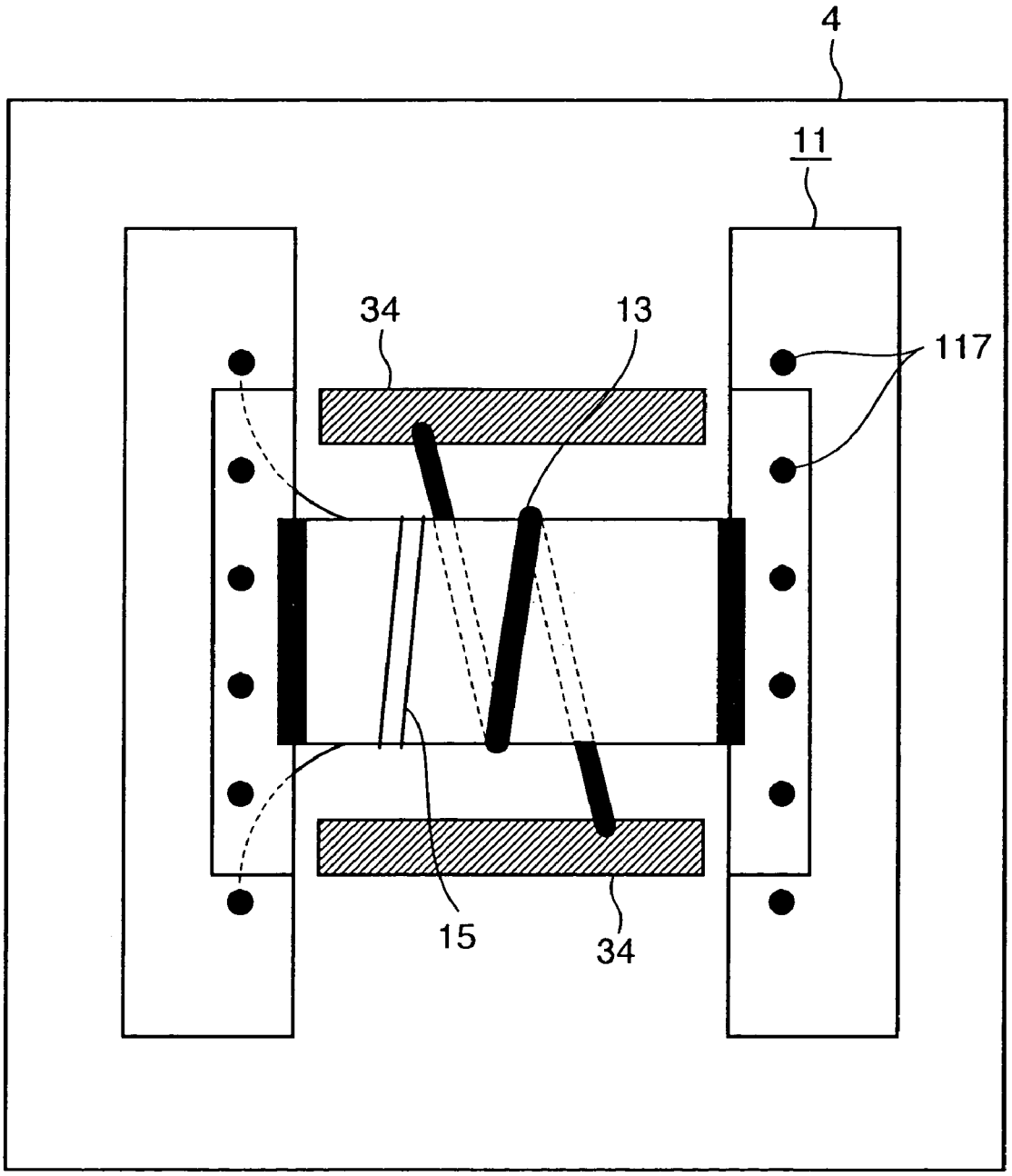
FIG. 15 is a plan view for explaining the structure of the transformer according to the second embodiment.

FIGS. 13, 14, and 15 are front, side, and plan views, respectively, for explaining the structure of a transformer.

A board 4 is a printed board having terminals 34 to be connected to the terminal end portions of a primary winding 13 of the transformer. The terminals 34 may be formed as copper foil lands of the board 4. Holes or through holes in which pin terminals 117 can be inserted are formed in the board 4.

When the primary winding 13 is wound on a winding core 111 and its terminal end portions are soldered to the terminals 34 in the same manner as in the first embodiment, the same effect as that of the first embodiment can be obtained. The board 4 may be one member that partly constitutes the transformer, or a circuit board itself on which the transformer is to be mounted. If the board 4 is the circuit board itself, the primary winding 13 is soldered to the terminals 34 directly, not through the terminals attached to the transformer. Thus, the resistance and cost can be decreased accordingly.

Figure 16:
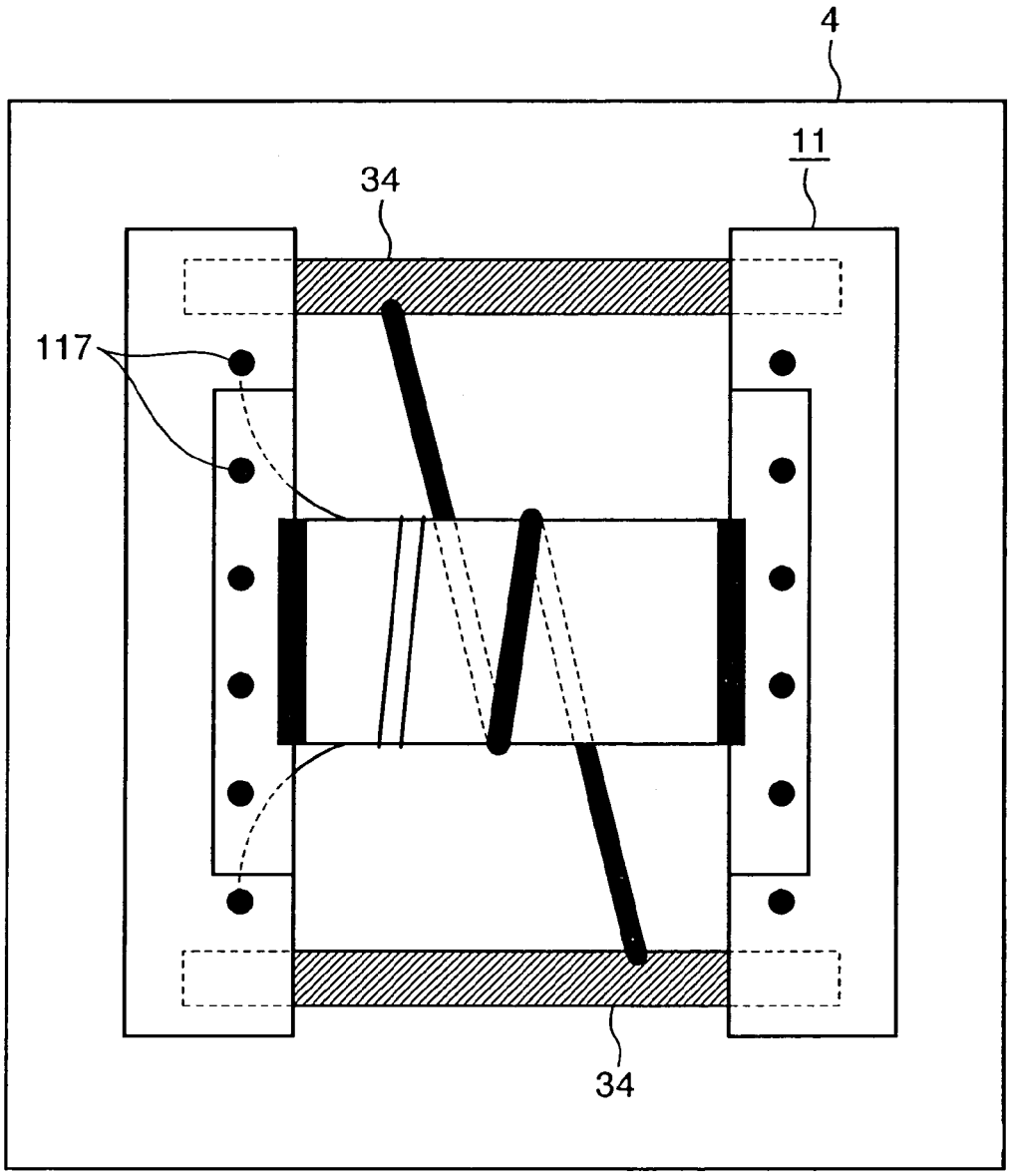
FIG. 16 is a plan view showing a modification of terminals.

The positions of the terminals 34 must oppose each other through the winding core. Also, the terminal end portions of the winding pulled out in the winding direction of the winding must be able to be fixed to the terminals within a region having the end portions of the winding space as boundaries. Note that the terminals 34 need not be confined within the region having the end portions of the winding space as boundaries. For example, as shown in FIG. 16, lands corresponding to the terminals 34 extend outside the winding space. Even if the lands are formed by extending the end portions of the winding space outside the boundaries, the terminal end portions of the winding can be fixed within the boundaries.

Figure 17:
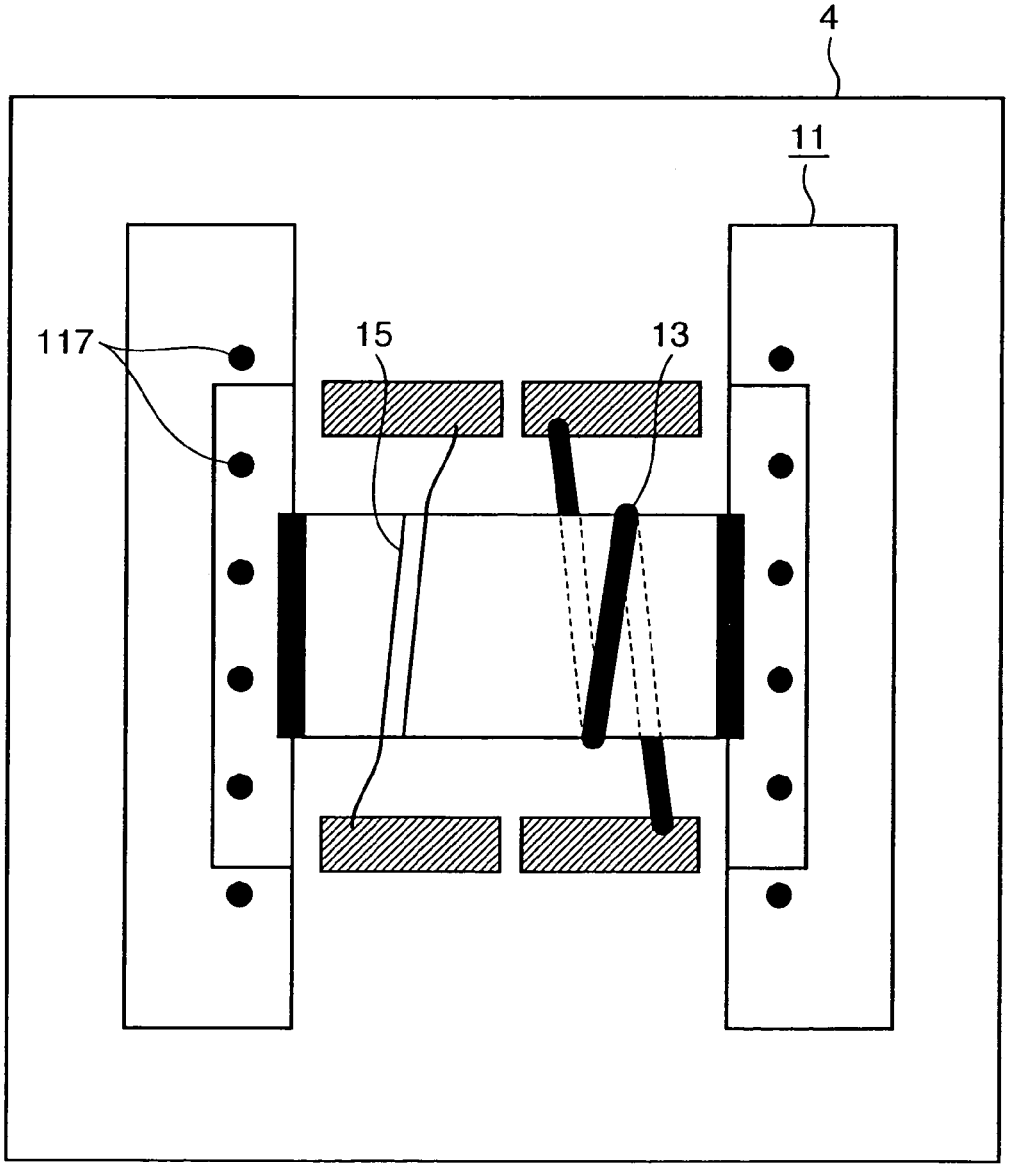
FIG. 17 is a plan view showing another modification of terminals.

As shown in FIG. 17, to use the lands of the board 4 as the terminals can be applied not only to the primary winding 13 but also to a secondary winding 15. If the secondary winding 15 has a particularly small number of turns, the same effect as that obtained with the primary winding 13 can be obtained.

Third Embodiment

An electrical device according to the third embodiment of the present invention will be described. In the third embodiment, arrangements that are substantially the same as the first and second embodiments are denoted by the same reference numerals, and a detailed description thereof will be omitted.

Figure 18:
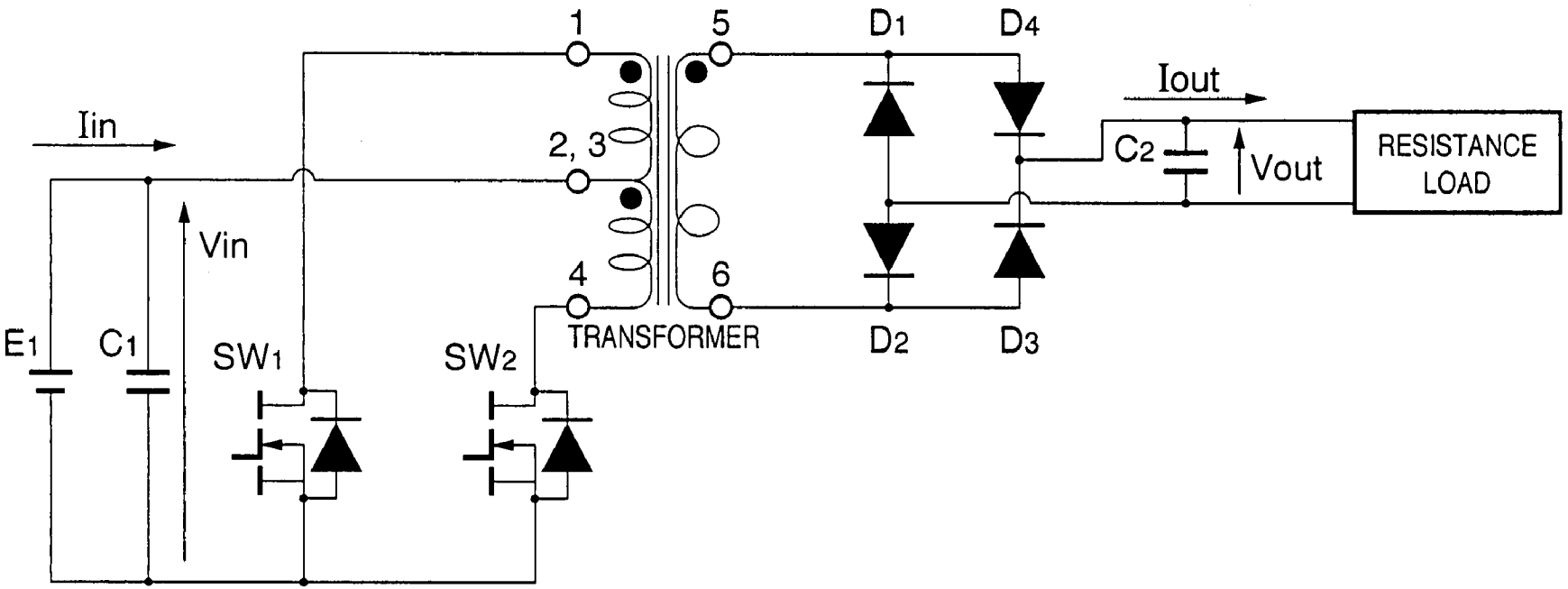
FIG. 18 is a circuit diagram showing an arrangement of a push-pull circuit.

In the following description, a transformer having a primary winding for a push-pull circuit will be described as the third embodiment. FIG. 18 is a circuit diagram showing an arrangement of the push-pull circuit. The transformer for the push-pull circuit has a set of primary windings that are connected in series with each other. The series connection point is extracted as the center tap of the primary windings.

Figure 19:
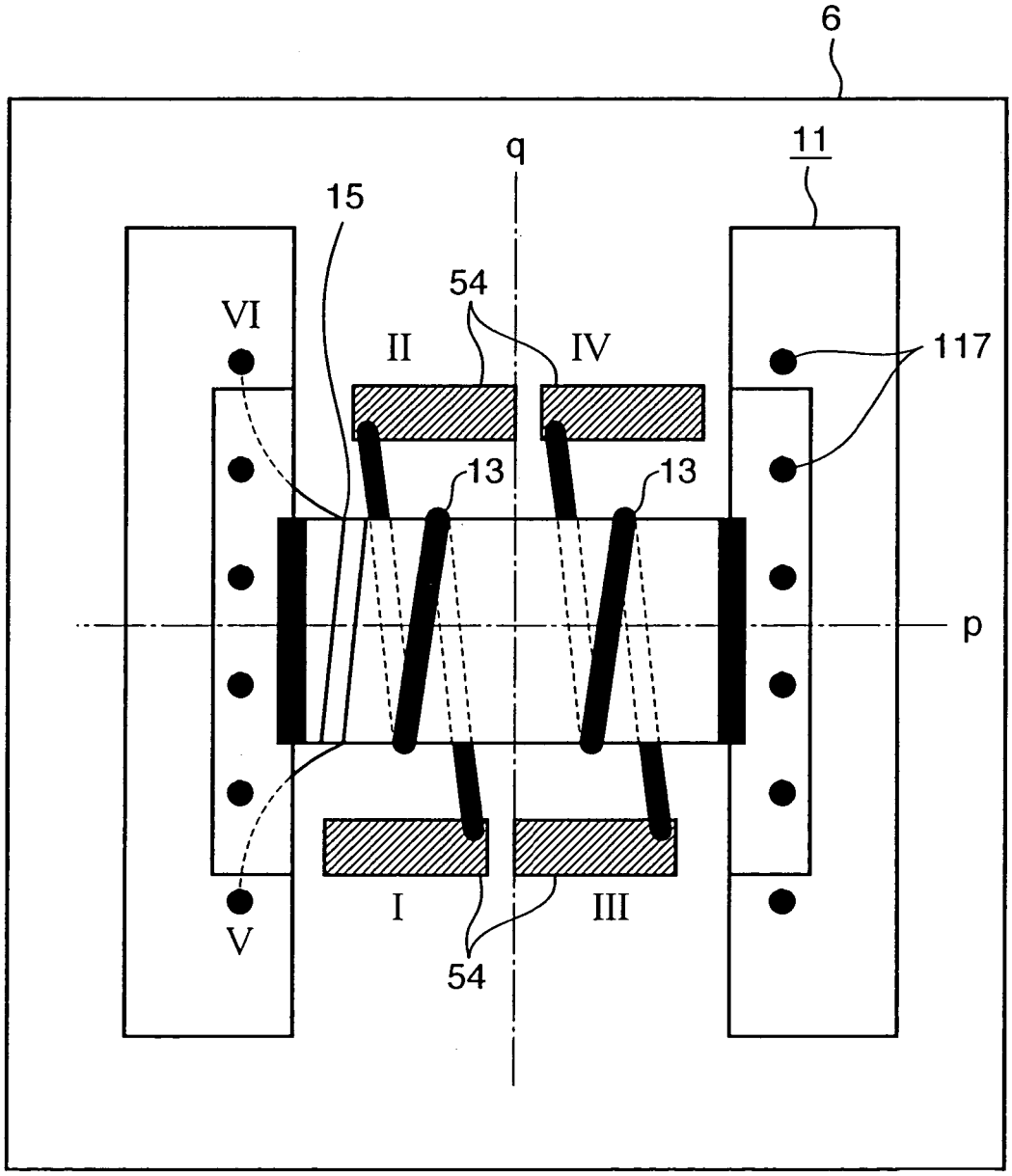
FIG. 19 is a plan view for explaining the structure of a transformer according to the third embodiment.

FIG. 19 is a plan view for explaining the structure of the transformer. Different from the second embodiment, the transformer of the third embodiment has two primary windings for the push-pull circuit, and a board 6 has terminals matching its winding arrangement. Reference numerals I to IV shown in FIG. 19 correspond to the terminal numbers of the transformer shown in FIG. 18.

As shown in FIG. 19, one set of primary windings 13 are wound on the transformer side by side. Terminals 54 are lands on the board 6, of which terminals Nos. 1 and 4 and terminals Nos. 2 and 3 are symmetrical with respect to the intersection (the center of the transformer) of a center axis p and straight line q. Although not shown, terminals Nos. 2 and 3 are connected through the conductor pattern of the board 6. In FIG. 19, the terminal ends of the left-side primary winding 13 are connected to terminals Nos. 1 and 2, and the terminal ends of the right-side primary winding 13 are connected to terminals Nos. 3 and 4.

The two primary windings 13 are arranged on the winding core 111 as evenly as possible, so that the winding space of a winding core 111 may be utilized as uniformly as possible. Each primary winding 13 is wound on the winding core 111 by one turn, in the same manner as on the board 4 of the second embodiment, so that the intersection (point A) of the extracting portions of each primary winding 13 falls on a lower surface S2 side. A secondary winding 15, an adhesive tape, and the primary windings 13 are wound on the winding core 111 in this order in the same manner as in the first embodiment. The terminal ends of the secondary winding 15 are connected to pin terminals Nos. 5 and 6 (117), as shown in FIG. 19.

As shown in FIG. 18, terminals Nos. 2 and 3 are connected to the positive electrode of a DC power supply E1, and terminals Nos. 1 and 4 are connected to the drain terminals of switching elements SW1 and SW2, respectively. Terminals Nos. 5 and 6 are connected to a diode bridge constituted by diodes D1 to D4.

The primary windings 13 were wound on the winding core 111 with the above procedure, and their terminal ends were fixed to the terminals 54. Despite that the two windings were wound side by side, the operation time was as short as about 2 min. The resistances of the two primary windings 13 were almost the same, i.e., 8.9 mΩ, and a resistance obtained by the series connection circuit of the two primary windings 13 was 18 mΩ.

COMPARATIVE EXAMPLE

Figure 20:
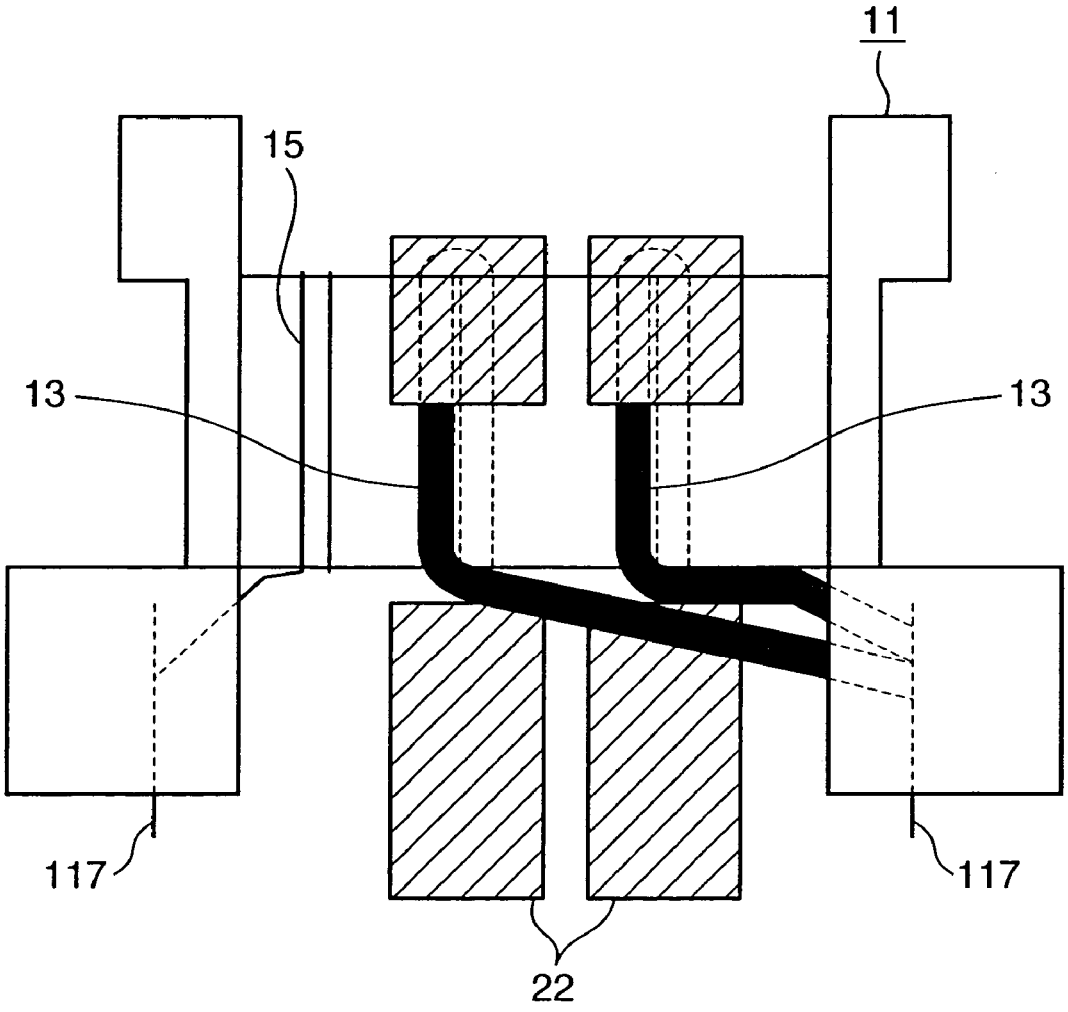
FIG. 20 is a front view showing a transformer according to a comparative example.
Figure 21:
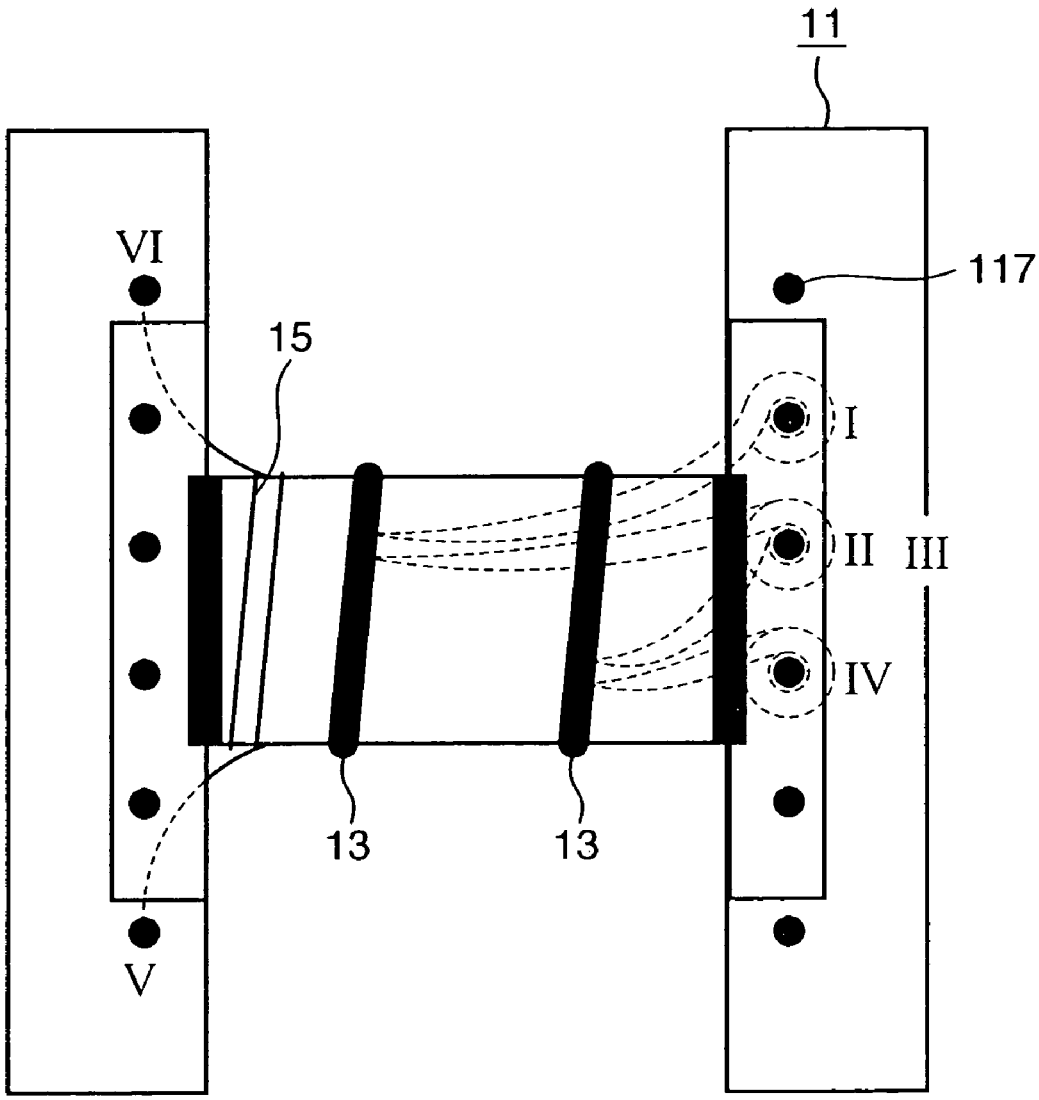
FIG. 21 is a plan view showing the transformer according to the comparative example of FIG. 20.

FIGS. 20 and 21 are front and plan views, respectively, showing a transformer according to a comparative example. This comparative example is obtained by modifying the transformer according to the comparative example of the first embodiment to have a winding arrangement for a push-pull circuit, in the same manner as in the transformers of the first and second embodiments.

As shown in FIG. 20, a set of primary windings 13 are wound on the winding space of a winding core 111 evenly, and are fixed to the winding core 111 with adhesive tapes. The four terminal ends of the primary windings 13 are soldered to pin terminals 117.

The primary windings 13 were wound on the winding core 111 with the above procedure, and their terminal ends were soldered to the pin terminals 117. Each coil maintained one turn. As shown in FIG. 20, however, the extracting portions of the adjacent coils interfered with each other to greatly degrade the workability, so the winding operation took a time of about 30 min. Adhesive tapes 22 and the extracting portions of the primary windings 13 occupied about 17 mm of the 23-mm winding space of the winding core 111. It was almost impossible to wound any more coils of the same type. When the resistances of the two primary windings 13 were measured, they were 10 mΩ and 8.2 mΩ, respectively, and the resistance of the series connection circuit of the two primary windings 13 was 18.9 mΩ. Consequently, when the transformer of the comparative example is applied to the push-pull circuit shown in FIG. 18, currents flowing in the two primary windings 13 may differ. The resistance of the series connection circuit of the two primary windings 13 is larger than the resistance of the transformer of the second embodiment by about 1 mΩ. Thus, a copper loss in the transformer increases.

In this manner, with the transformer of the third embodiment for the push-pull circuit, the same effect as that of the first embodiment can be obtained. In addition, according to the third embodiment, when a plurality of coils are to be wound on one winding core 111, the resistances of the respective coils can be set substantially equal. This structure is appropriate as a transformer for a push-pull circuit in which currents flowing in the respective coils are required to be uniform. Since the resistances of the respective coils decrease, the copper loss of the transformer can also be decreased.

Fourth Embodiment

An electrical device according to the fourth embodiment of the present invention will be described. In the fourth embodiment, arrangements that are substantially the same as those of the first, second, and third embodiments are denoted by the same reference numerals, and a detailed description thereof will be omitted.

Figure 22:
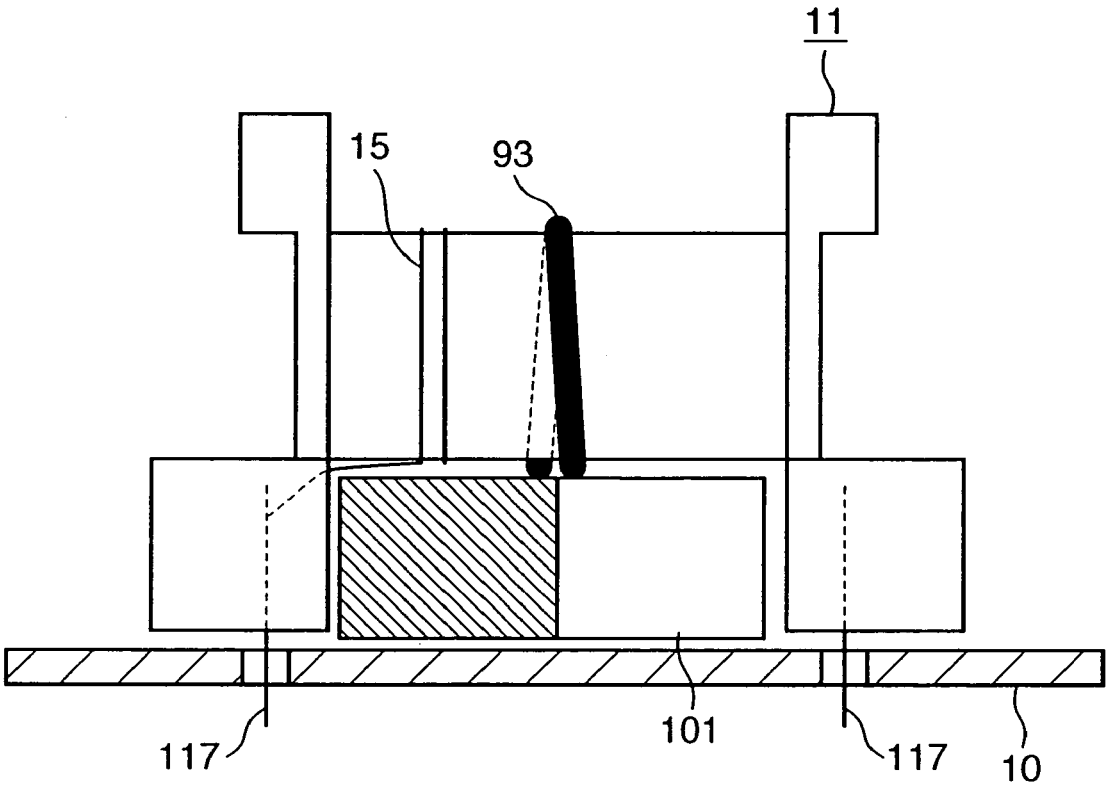
FIG. 22 is a front view for explaining the structure of a transformer according to the fourth embodiment.
Figure 23:
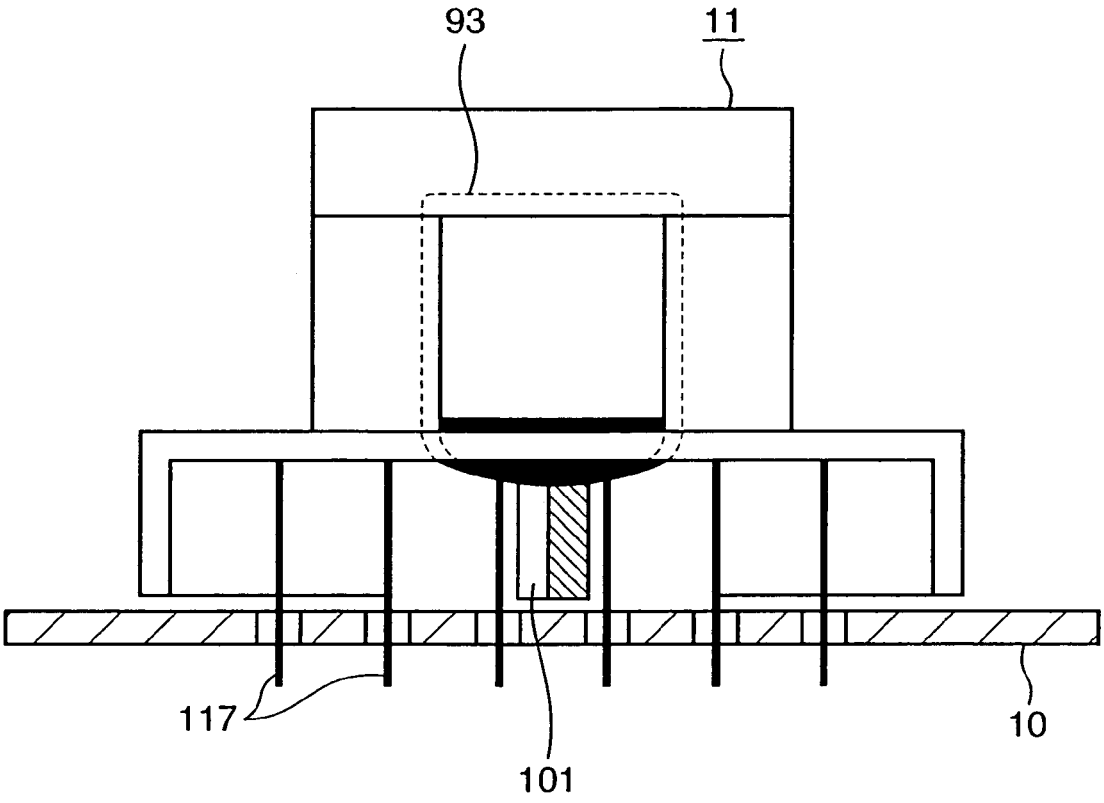
FIG. 23 is a side view for explaining the structure of the transformer according to the fourth embodiment.
Figure 24:
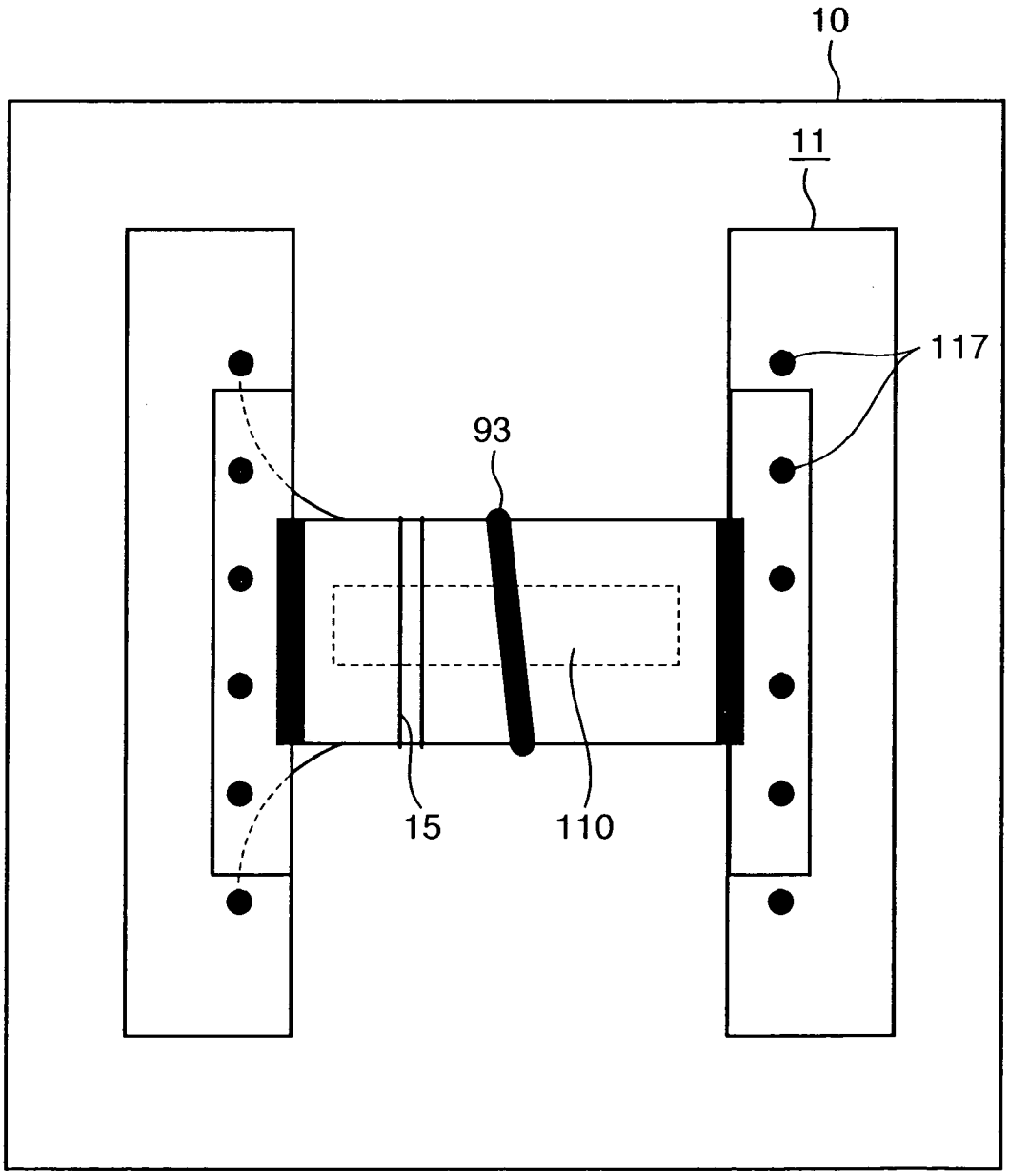
FIG. 24 is a plan view for explaining the structure of the transformer according to the fourth embodiment.

FIGS. 22 to 24 are front, side, and plan views, respectively, of a transformer according to the fourth embodiment. A primary winding 93 of the fourth embodiment is a flat square copper wire identical to the primary winding 13 of the first embodiment. In the transformer of the fourth embodiment, a secondary winding 15, an adhesive tape (not shown), and the primary winding 93 are wound onto a winding core 111 in the order named. The terminal ends of the secondary winding 15 are connected to pin terminals 117, as shown in FIGS. 22 and 24.

Figure 25:
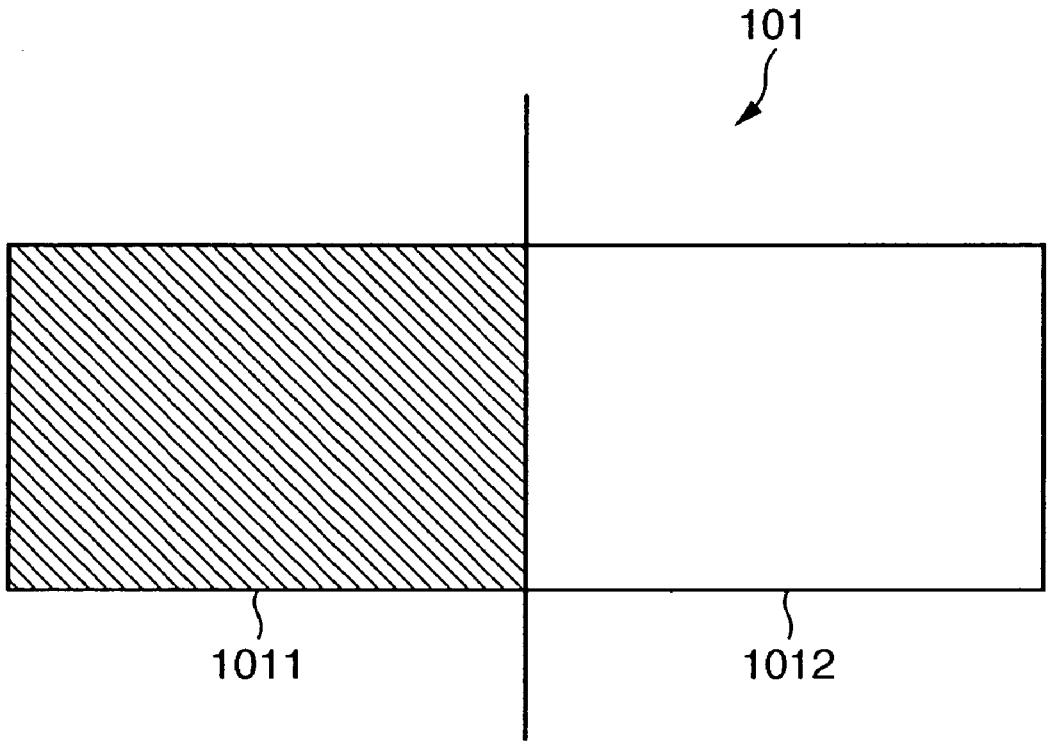
FIG. 25 is a view for explaining a holding member.
Figure 26:
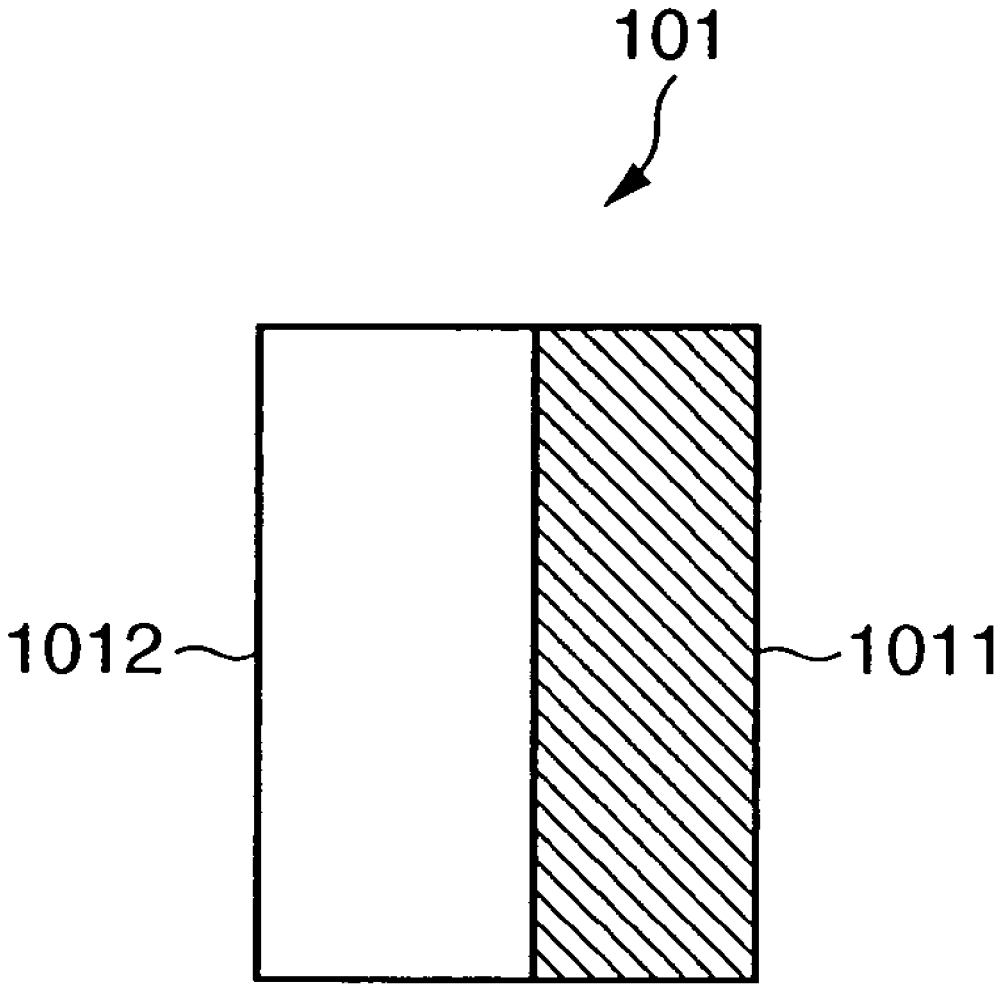
FIG. 26 is a view for explaining the holding member.
Figure 27:
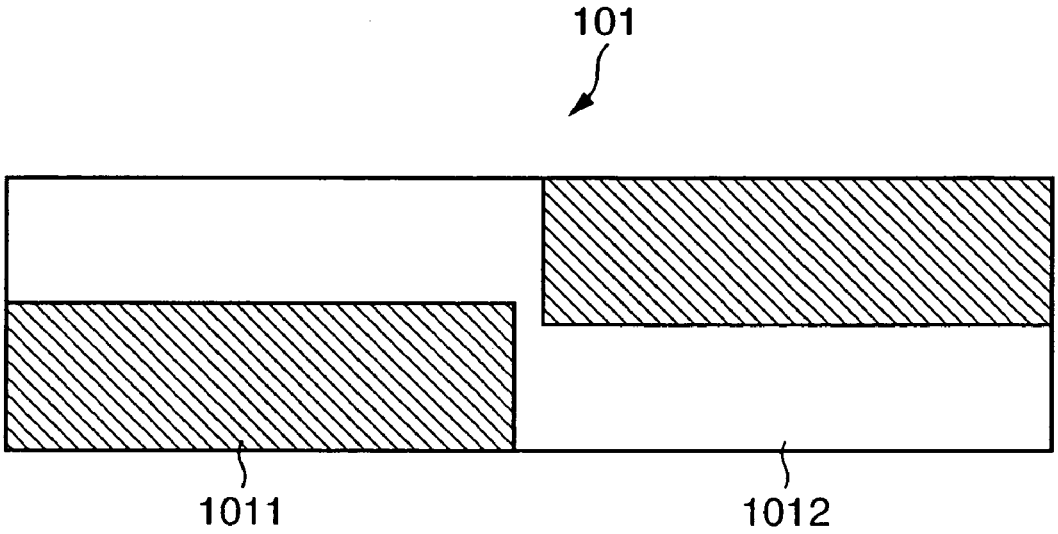
FIG. 27 is a view for explaining the holding member.
Figure 28:
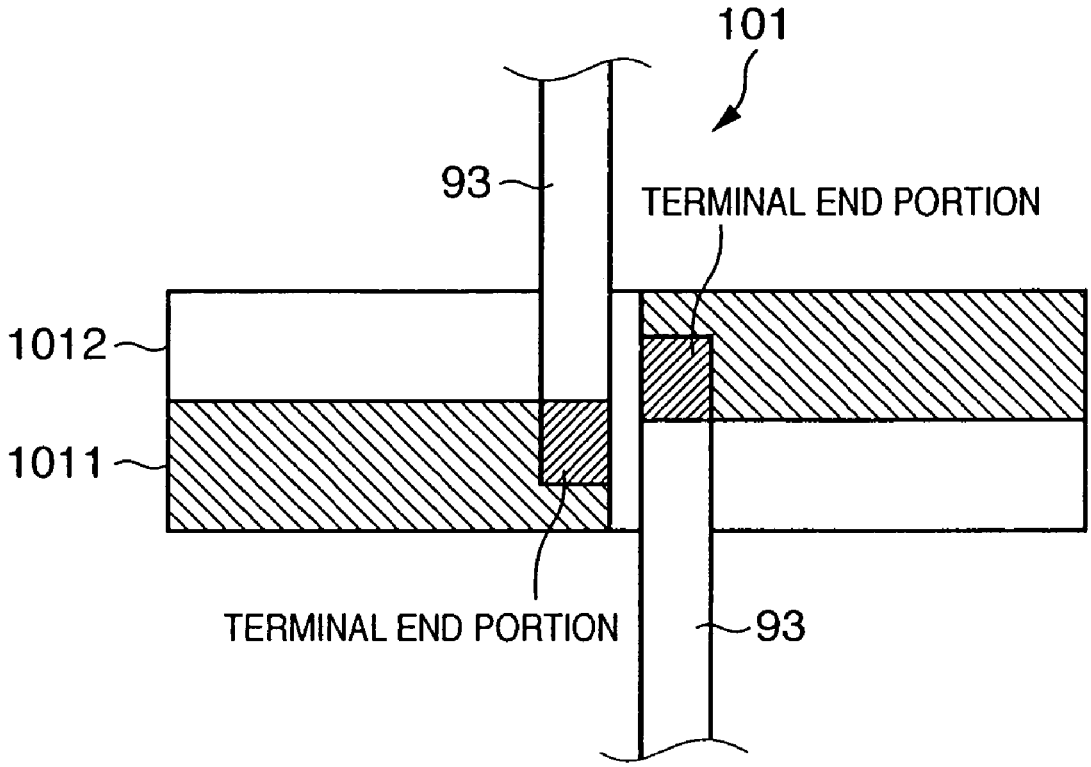
FIG. 28 is a view for explaining the holding member.

According to the characteristic feature of the fourth embodiment, the mounting surface of a board 10 on which the transformer is to be mounted has a holding member 101 which comes into electrical contact with the terminal ends of the primary winding 93. FIGS. 25 to 27 are front, side, and plan views, respectively, of the holding member 101. An elevation seen in the same direction as in the front view of the board 10 will be defined as the front view of the holding member 101. FIG. 28 is a view showing the connection relationship between the holding member 101 and the terminal ends of the primary winding 93. The holding member 101 is a component formed of conductive portions 1011 and insulating portions 1012 and which is to be soldered to the board 10.

As shown in FIG. 28, the conductive portions 1011 are made of, e.g., copper. The terminal ends of the primary winding 93 come into contact with the conductive portions 1011, so that the terminal ends serve as the terminals of the transformer. As shown in FIG. 24, the center of the holding member 101 is located almost at the intersection of a center axis p and the straight line q, and almost coincides with the center of the transformer. The holding member 101 comes into contact with the terminal ends of the primary winding 93 at a point A, on substantially the same plane as a lower surface S2, where the extracting portions of the primary winding 93 intersect. Thus, the length of the primary winding 93 becomes almost the shortest. In the fourth embodiment, to connect the terminal ends of the primary winding 93 and the conductive portions 1011 to each other, solder may be applied to the terminal ends and the conductive portions 1011 in advance. The terminal ends are brought into contact with the conductive portions 1011. The solder is fused by, e.g., applying a soldering iron to the side surfaces of the conductive portions 1011. The conductive portions 1011 and the terminal ends are thus electrically connected to each other. The primary winding 93 is wound within the center plane S1, so that their terminal ends fall on the conductive portions 1011, as shown in FIGS. 24 and 28.

When the transformer was assembled with the above procedure, the coil formed of the primary winding 93 could maintain one turn without using an adhesive tape, in the same manner as in the first to third embodiments. The resistance of the primary winding 93 obtained by actual measurement was 6.3 mΩ, and was 6.5 mΩ even considering the holding member 101 between the terminal ends of the primary winding 93 to the mounting surface of the board 10. When compared to 8.9 mΩ which is the measured value of the resistance of the primary winding 13 of the second embodiment, the resistance of the fourth embodiment was decreased by about 27%. In that portion of the holding member 101 which is closer to the intersection A, as the primary winding 93 is pressed against the winding core 111, the gap between the winding core 111 and primary winding 93 decreases more, so that magnetic coupling of the primary winding 93 with magnetic cores 12 is improved.

In this manner, when the holding member 101 is used, the primary winding 93 maintains one turn without using an adhesive tape. Since the resistance of the primary winding 93 could be decreased more and the gap between the primary winding 93 and magnetic cores 12 could be minimized, magnetic coupling was improved, and the conversion efficiency of the transformer could be improved.

As shown in FIG. 27, a gap of about 1 mm is provided between the two conductive portions 1011 in order to ensure insulation. This gap is not limited. To decrease the copper loss, the larger the sectional areas of the conductive portions 1011, the better. If a projection with almost the same height as that of the holding member 101 is formed on the board 10 so that it may be substituted for the holding member 101, the arrangement is simplified, and the resistance and cost can be decreased. Naturally, the shape and position of the holding member 101 are not limited to those described above. It suffices as far as those portions of the holding member 101 with which the terminal ends of the primary winding 93 come into contact are made of conductors and the conductors form terminals.

According to the embodiments described above, the following effects can be obtained.

(1) In a transformer or inductor in which one or more coils are wound on the winding core, extracting portions pulled out in the winding direction of the winding intersect and are fixed to terminals which oppose each other through the winding core and which are arranged within a region having the end portions of the winding space of the winding core as boundaries. With this arrangement, the transformer or inductor does not need any adhesive tape for fixing the winding to the winding core. The transformer can be downsized by effectively utilizing the winding space. The winding process is simplified and the workability is improved largely. Thus, the time taken by the winding process is shortened, which is very effective in reducing the cost of the transformer. As the extracting portions are pulled out in the winding direction of the winding, operation such as bending the electric wire by applying an excessive force to it becomes unnecessary, providing excellent workability. An electric wire having a larger section can thus be wound, so that the degrees of freedom in designing the transformer increase. Naturally, the damage to the conductor or insulating covering of the wiring in the wiring operation can also be decreased.

(2) In a transformer or inductor in which one or more coils are wound on the winding core, extracting portions pulled out in the winding direction of the winding intersect and are fixed to terminals on the board which oppose each other through the winding core and which are arranged within a region having the end portions of the winding space of the winding core as boundaries. With this arrangement, the same effect as that of the above item (1) can be obtained. Also, since the terminal ends of the winding are soldered to the terminals on the board directly and not through terminals arranged on the transformer, the resistance of the winding can be decreased. No terminals need be arranged on the transformer itself, so that the transformer has a very simple shape as a whole. The cost of the transformer and board can thus be reduced.

(3) The transformer of (1) or (2) can be used for a push-pull circuit. In this case, the same effect as that of the above item (1) or (2) can be obtained. Also, the entire lengths of the plurality of coils wound on one winding core become almost equal. When this transformer is used as a transformer for a push-pull circuit, currents flowing in the respective coils do not become non-uniform. The resistances of the respective coils also decrease. Thus, the copper loss of the transformer can be decreased.

(4) A projecting member to come into contact with the extracting portions is formed on the board, at least in the vicinity of the intersection of the extracting portions, and at least those portions of the projecting member which are to come into contact with the terminal ends of the extracting portions are formed of conductors, so that these portions serve as terminals. With this arrangement, the resistance of the coil wound on the winding core can be decreased very low, and the gap between the winding and the magnetic core can be minimized. Therefore, the conversion efficiency of the transformer can be improved. As has been described above, according to the present invention, winding can be facilitated.

As many apparently widely different embodiments of the present invention can be made without departing from the spirit and scope thereof, it is to be understood that the invention is not limited to the specific embodiments thereof except as defined in the appended claims.

What is claimed is:

1. An electrical device comprising:

at least one coil which is wound on a winding surface of a winding core; and at least one set of terminals which oppose each other through said winding surface and which are arranged within a region having end portions of said winding surface as boundaries, wherein a surface of each terminal is along the length of said winding surface, and wherein extracting portions of a coil of said at least one coil intersect, said coil of said at least one coil having one turn, and wherein terminal ends of said extracting portions are connected to said terminals.

2. The device according to claim 1, wherein said extracting portions have one intersection.

3. The device according to claim 1, wherein the intersection of said extracting portions is arranged closest to a surface on which the electrical device is to be mounted.

4. The device according to claim 1, wherein the intersection of said extracting portions is substantially flush with a surface on which the electrical device is to be mounted.

5. The device according to claim 1, wherein a plurality of senes-connected coils are wound on said winding core.

6. The device according to claim 5, wherein said plurality of series-connected coils are used for a push-pull circuit.

7. An electrical device comprising:

at least one coil which is wound on a winding surface of a winding core; and members which are arranged below said winding surface and in contact with terminal ends of a coil of said at least one coil, said coil of said at least one coil having one turn, and wherein said members electrically connect the terminal ends to an electrical circuit of a board on which the electrical device is to be mounted, and wherein a surface of each member is along the length of said winding surface.

8. The device according to claim 7, wherein said members are soldered to said board.

9. The device according to claim 8, wherein at least a portion of each member which is in contact with the terminal end comprises a conductor.

10. An electrical device comprising:

at least one coil which is wound on a winding surface of a winding core; and a board having at least one set of terminals which oppose each other through said winding surface and which are arranged within a region having end portions of said winding surface as boundaries, wherein a surface of each terminal is along the length of said winding surface, and wherein extracting portions of a coil of said at least one coil intersect, said coil of said at least one coil having one turn, and wherein terminal ends of said extracting portions are connected to said terminals.

11. The device according to claim 10, wherein said terminals are formed as lands on said board.

12. The device according to claim 10, wherein said extracting portions have one intersection.

13. The device according to claim 10, wherein the intersection of said extracting portions is arranged closest to a surface on which the electrical device is to be mounted.

14. The device according to claim 10, wherein the intersection of said extracting portions is substantially flush with a surface on which the electrical device is to be mounted.

15. The device according to claim 10, wherein a plurality of series-connected coils are wound on said winding core.

16. The device according to claim 15, wherein said plurality of series-connected coils are used for a push-pull circuit.

17. An electrical device comprising:

a winding core forming a winding portion thereof and having a hollow hole portion where a magnetic core is to be inserted;

at least one primary coil and at least one secondary coil which are wound on said winding portion; and at least one set of terminals which oppose each other through the winding portion and which are disposed within a region having two end openings of the hollow hole portion as boundaries, wherein a surface of each terminal is along the length of said winding portion, and wherein extracting portions of a coil of said at least one primary or secondary coil intersect on an outer surface of said winding portion, said coil of said at least one primary or secondary coil having one turn, and wherein terminal ends of said extracting portions are electrically connected to said terminals.

18. The device according to claim 17, wherein said winding core is formed of an electrical insulator by monolithic molding such that a plurality of pin terminal arrays are arranged in the vicinities of the two end openings to oppose each other, said terminals are continuously arranged between said pin terminal arrays, and said terminal ends are connected to said terminals at a minimum distance.

19. The component according to claim 17, wherein said winding core is formed of an electrical insulator by monolithic molding such that a plurality of pin terminal arrays are arranged in the vicinities of the two end openings to oppose each other, said pin terminal arrays are inserted in mounting hole portions including lands of a board, said terminals are arranged on said board, and said respective terminal ends are connected to said terminals at a minimum distance.

20. The component according to claim 19, wherein said winding core is formed of an electrical insulator by monolithic molding such that a plurality of pin terminal arrays are arranged in the vicinities of the two end openings to oppose each other, said pin terminal arrays are inserted in mounting hole portions of a board, and said respective terminal ends are connected to said terminals at a minimum distance through a holding member arranged on said board.

* * * * *

UNITED STATES PATENT AND TRADEMARK OFFICE

CERTIFICATE OF CORRECTION

PATENT NO. : 7,091,815 B2
APPLICATION NO. : 10/737780
DATED : August 15, 2006
INVENTOR(S) : Masaki Suzui It is certified that error appears in the above-identified patent and that said Letters Patent is hereby corrected as shown below:

COLUMN 1:
Line 64, "is comprising" should read -- comprises --.

COLUMN 3:
Line 28, "an" should read -- and --; and
Line 37, "legs 11" should read -- legs 11; --.

COLUMN 9:
Line 65, "wound" should read -- wind --.

COLUMN 13:
Line 5, "senes-connected" should read -- series-connected --.

COLUMN 14:
Lines 30 and 38, "component" should read -- device --.

Signed and Sealed this

Third Day of July, 2007

JON W. DUDAS
*Director of the United States Patent and Trademark Office*